US008210666B2

(12) United States Patent
Hirashima

(10) Patent No.: US 8,210,666 B2
(45) Date of Patent: Jul. 3, 2012

(54) LIQUID SUPPLYING DEVICE, LIQUID DISCHARGING DEVICE, AND METHOD OF CONTROLLING LIQUID DISCHARGING DEVICE

(75) Inventor: Shigeyoshi Hirashima, Kanagawa (JP)

(73) Assignee: Sony Corporation, Tokyo (JP)

( * ) Notice: Subject to any disclaimer, the term of this patent is extended or adjusted under 35 U.S.C. 154(b) by 356 days.

(21) Appl. No.: 12/507,974

(22) Filed: Jul. 23, 2009

(65) Prior Publication Data

US 2010/0026739 A1 Feb. 4, 2010

(30) Foreign Application Priority Data

Jul. 30, 2008 (JP) ..... 2008-196303
Jul. 30, 2008 (JP) ..... 2008-196304
Jul. 30, 2008 (JP) ..... 2008-196305
Jul. 30, 2008 (JP) ..... 2008-196306

(51) Int. Cl.
*B41J 2/175* (2006.01)

(52) U.S. Cl. ..... 347/85; 347/89

(58) Field of Classification Search ..... 347/66, 347/84, 85, 89; 141/2, 18
See application file for complete search history.

(56) References Cited

U.S. PATENT DOCUMENTS 4,680,696 A * 7/1987 Ebinuma et al. ..... 347/85
5,159,348 A * 10/1992 Dietl et al. ..... 347/89
6,217,164 B1 * 4/2001 Hino ..... 347/85
6,443,560 B1 * 9/2002 Okano et al. ..... 347/55
6,561,637 B2 * 5/2003 Hino ..... 347/92
6,742,882 B2 * 6/2004 Nakamura ..... 347/89
7,246,874 B2 * 7/2007 Hirakata et al. ..... 347/29
7,896,966 B2 * 3/2011 Masuyama et al. ..... 118/600

FOREIGN PATENT DOCUMENTS

JP HEI 05-321847 A 12/1993
JP HEI 06-008465 A 1/1994
JP HEI 10-211718 A 8/1998
JP 2000-127440 A 5/2000
JP 2000-309109 A 11/2000
JP 2000-313124 A 11/2000
JP 2003-049644 A 2/2003
JP 2006-150745 A 6/2006
JP 2007-144732 A 6/2007
JP 2008-023806 A 2/2008
JP 2008-126414 A 6/2008
JP 2008-132762 6/2008

OTHER PUBLICATIONS

Japanese Patent Office, Office Action issued in Patent Application JP 2008-196303, on May 11, 2010.
Japanese Patent Office, Office Action issued in Patent Application JP 2008-196304, on May 11, 2010.
Japanese Patent Office, Office Action issued in Patent Application JP 2008-196305, on May 11, 2010.
Japanese Patent Office, Office Action issued in Patent Application JP 2008-196306, on May 11, 2010.

* cited by examiner

*Primary Examiner* — Anh T. N. Vo
(74) *Attorney, Agent, or Firm* — SNR Denton US LLP

(57) ABSTRACT

A liquid supplying device includes a liquid tank storing liquid that is supplied to a consumption object that consumes the liquid, a transfer pump for transferring the liquid stored in the liquid tank, an auxiliary tank temporarily storing the liquid transferred by the transfer pump before supplying the liquid to the consumption object, and a return pipe disposed so as to return the liquid to the liquid tank from the auxiliary tank when an amount of the liquid stored in the auxiliary tank becomes greater than or equal to a certain amount.

15 Claims, 19 Drawing Sheets

LIQUID SUPPLYING DEVICE, LIQUID DISCHARGING DEVICE, AND METHOD OF CONTROLLING LIQUID DISCHARGING DEVICE

BACKGROUND OF THE INVENTION

1. Field of the Invention

The present invention relates to a liquid supplying device for supplying liquid to a consumption object that consumes the liquid (a liquid discharging head that discharges ink), a liquid discharging device, and a method of controlling the liquid discharging device. In addition, more specifically, the present invention relates to a technology that can easily stabilize the height of a liquid surface in an auxiliary tank that temporarily stores liquid prior to supplying the liquid to a consumption object that consumes the liquid.

2. Description of the Related Art

Hitherto, as an example of a liquid discharging device that discharges (consumes) a liquid, an inkjet printer that forms an image by supplying ink (the liquid) to a liquid discharging head and by discharging the ink towards a recording sheet from a nozzle of the liquid discharging head is available. In such an inkjet printer, for stably discharging the ink, it is demanded that the ink be stably supplied to the liquid discharging head from an ink cartridge (ink tank) that stores the ink.

For stably discharging the liquid from the inkjet printer, it is necessary for the pressure of the ink in the liquid discharging head to be slightly negative with respect to atmospheric pressure. When the negative pressure is too low, the ink tends to leak from the nozzle, and the ink is unstably discharged. In contrast, when the negative pressure is too high, a proper amount of ink is not discharged, and the ink discharge becomes unstable.

Therefore, for maintaining a proper negative pressure in the liquid discharging head, in general, a porous material (such as urethane foam) is accommodated in the ink cartridge, and negative pressure is generated by capillarity of the porous material. A method of generating negative pressure by storing the ink in a flexible ink bag and pulling the ink bag by, for example, a spring is also available.

However, in recent inkjet printers, for achieving a high speed, the number of nozzles tend to be increased. In particular, since, in a line-head inkjet printer, a plurality of nozzles are disposed in accordance with the width of a recording sheet having the largest size that can be printed, the number of nozzles is very large compared to that of a serial head printer that performs printing by being moved in a sheet width direction. Therefore, the amount of consumption of ink per unit time is large, and, in the method that generates negative pressure by a porous material, there is not enough ink that can be supplied. In addition, in the method that pulls a flexible ink bag, a large spring is used for reducing changes in negative pressure, thereby increasing the size of the inkjet printer.

Due to such circumstances, a technology in which ink is temporarily stored in a subtank (auxiliary tank) prior to supplying the ink to the liquid discharging head and in which the subtank is disposed below a nozzle to maintain a negative pressure on the basis of a water head difference is provided. If an ink holding volume of the subtank is sufficiently ensured, and the height of an ink liquid surface in the subtank is maintained in a predetermined range, the pressure of the ink in the liquid discharging head becomes a negative pressure in a proper range allowing a meniscus to be formed (refer to, for example, Japanese Unexamined Patent Application Publication No. 2008-132762 (Patent Document 1)).

SUMMARY OF THE INVENTION

However, in the technology discussed in Patent Document 1, for maintaining the height of the ink liquid surface in the subtank within the predetermined range, it is necessary to use a sensor that controls the height of the liquid surface. In particular, if an inkjet printer is a color inkjet printer, a subtank is used for every color of ink (at least three colors; six or eight colors when many colors are used). Therefore, it is necessary to use a large number of sensors. Consequently, the inkjet printer not only becomes large, but also becomes expensive.

Therefore, it is desirable to make it possible to easily stabilize the height of a liquid surface in a subtank (auxiliary tank) that temporarily stores ink (liquid) prior to supplying the ink to a liquid discharging head (consumption object that consumes the liquid), and to make it possible to achieve a small, low-cost device.

According to the present invention, the aforementioned problems can be solved by the following devices and method.

According to an embodiment of the present invention, there is provided a liquid supplying device including a liquid tank storing liquid that is supplied to a consumption object that consumes the liquid, a transfer pump for transferring the liquid stored in the liquid tank, an auxiliary tank temporarily storing the liquid transferred by the transfer pump before supplying the liquid to the consumption object, and a return pipe disposed so as to return the liquid to the liquid tank from the auxiliary tank when an amount of the liquid stored in the auxiliary tank becomes greater than or equal to a certain amount.

According to the embodiment of the present invention, the liquid stored in the liquid tank is transferred by the transfer pump, and is temporarily stored in the auxiliary tank prior to supplying the liquid to the consumption object. Then, when the liquid stored in the auxiliary tank becomes greater than or equal to the certain amount, the liquid is returned to the liquid tank from the auxiliary tank by the return pipe. Therefore, in the liquid supplying device that supplies the liquid to the consumption object, the liquid in the auxiliary tank, provided in a transfer path for transferring the liquid to the consumption object, does not become greater than or equal to the certain amount.

According to another embodiment of the present invention, there is provided a liquid discharging device including a liquid discharging head capable of discharging supplied liquid from a nozzle, a liquid tank storing the liquid that is discharged by the liquid discharging head, a transfer pump for transferring the liquid stored in the liquid tank, an auxiliary tank temporarily storing the liquid transferred by the transfer pump before supplying the liquid to the liquid discharging head, and a return pipe disposed so as to return the liquid to the liquid tank from the auxiliary tank when an amount of the liquid stored in the auxiliary tank becomes greater than or equal to a certain amount.

According to the another embodiment of the present invention, the liquid stored in the liquid tank is transferred by the transfer pump, and is temporarily stored in the auxiliary tank prior to supplying the liquid to the liquid discharging head. Then, when the liquid stored in the auxiliary tank becomes greater than or equal to the certain amount, the liquid is returned to the liquid tank from the auxiliary tank by the return pipe. Therefore, in the liquid discharging device that discharges the liquid from a nozzle of the liquid discharging head, the liquid in the auxiliary tank, provided in a transfer path for transferring the liquid to the liquid discharging head, does not become greater than or equal to the certain amount.

As a result, the pressure of the liquid in the liquid discharging head is maintained in a proper range that is in accordance with the height of a liquid surface in the auxiliary tank.

According to still another embodiment of the present invention, there is provided a method of controlling a liquid discharging device. The liquid discharging device includes a liquid discharging head capable of discharging supplied liquid from a nozzle, a liquid tank storing the liquid that is discharged by the liquid discharging head, a transfer pump for transferring the liquid stored in the liquid tank, a controlling device for controlling driving of the transfer pump, an auxiliary tank temporarily storing the liquid transferred by the transfer pump before supplying the liquid to the liquid discharging head, the auxiliary tank being disposed below the nozzle so that pressure of the liquid in the liquid discharging head is a negative pressure, and a return pipe disposed so as to return the liquid to the liquid tank from the auxiliary tank when an amount of the liquid stored in the auxiliary tank becomes greater than or equal to a certain amount. The method includes the step of driving the transfer pump so that $t \geqq (Q/V)$ by the controlling device, where a driving time for driving the transfer pump is t, an amount of the transfer of the liquid per unit time by the transfer pump is V, and an amount of change of the liquid in the auxiliary tank is Q, the amount of change of the liquid in the auxiliary tank allowing, with respect to atmospheric pressure, the pressure of the liquid in the liquid discharging head to be maintained at the negative pressure in a range allowing the liquid to be stably discharged while preventing leakage of the liquid from the nozzle.

According to the still another embodiment of the present invention, the liquid stored in the liquid tank is transferred by the transfer pump, and is temporarily stored in the auxiliary tank prior to supplying the liquid to the liquid discharging head. The driving time t in which the transfer pump is driven is greater than or equal to a value (Q/V) obtained by dividing the amount Q of change of the liquid in the auxiliary tank, which can maintain the liquid in the liquid discharging head at a negative pressure, by the amount V of transfer of the liquid per unit time of the transfer pump. When the liquid stored in the auxiliary tank becomes greater than or equal to the certain amount, the liquid is returned to the liquid tank from the auxiliary tank by the return pipe. Therefore, even when the liquid is discharged from the nozzle of the liquid discharging head, and the liquid in the auxiliary tank is consumed, the auxiliary tank is properly replenished with liquid. Moreover, the liquid in the auxiliary tank does not become greater than or equal to the certain amount by the replenishment. As a result, the pressure of the liquid in the liquid discharging head is maintained at a negative pressure that is in a proper range with respect to atmospheric pressure.

According to the liquid supplying device of the embodiment of the present invention, when the liquid stored in the auxiliary tank becomes greater than or equal to the certain amount, the liquid is returned to the liquid tank from the auxiliary tank by the return pipe. Therefore, in the liquid supplying device that supplies the liquid to the consumption object, the liquid in the auxiliary tank, provided in the transfer path for transferring the liquid to the consumption object, does not become greater than or equal to the certain amount. Consequently, the height of the liquid surface in the auxiliary path can be easily stabilized without controlling the height of the liquid surface with, for example, a sensor provided at the auxiliary tank.

According to the liquid discharging device of the another embodiment of the present invention, when the liquid stored in the auxiliary tank becomes greater than or equal to the certain amount, the liquid is returned to the liquid tank from the auxiliary tank by the return pipe. Therefore, in the liquid discharging device that discharges the liquid from the nozzle of the liquid discharging head, the liquid in the auxiliary tank, provided in the transfer path for transferring the liquid to the liquid discharging head, does not become greater than or equal to the certain amount. As a result, the pressure of the liquid in the liquid discharging head is maintained in a proper range that is in accordance with the height of the liquid surface in the auxiliary tank. Therefore, it is possible to easily stabilize the discharge of the liquid from the nozzle.

According to the method of controlling the liquid discharging device of the still another embodiment of the present invention, even when the liquid is discharged from the nozzle of the liquid discharging head, and the liquid in the auxiliary tank is consumed, the auxiliary tank is properly replenished with liquid. Moreover, the liquid in the auxiliary tank does not become greater than or equal to the certain amount by the replenishment. As a result, the pressure of the liquid in the liquid discharging head is maintained at a negative pressure that is in a proper range with respect to atmospheric pressure. Consequently, it is possible to easily stabilize the supply of the liquid to the liquid discharging head and the discharge of the liquid from the nozzle.

DESCRIPTION OF THE PREFERRED EMBODIMENTS

An embodiment according to the present invention will hereunder be described with reference to, for example, the drawings.

In the embodiment according to the present invention below, as a liquid supplying device and a liquid discharging device, an inkjet printer 10 is given as an example and described below. The inkjet printer 10 is a color inkjet printer that supplies ink (liquid) of four colors to a line head 20 (corresponding to a consumption object that consumes the liquid and a liquid discharging head in the present invention) and that discharges the ink. The four colors are yellow (Y), magenta (M), cyan (C), and black (K).

Figure 1:
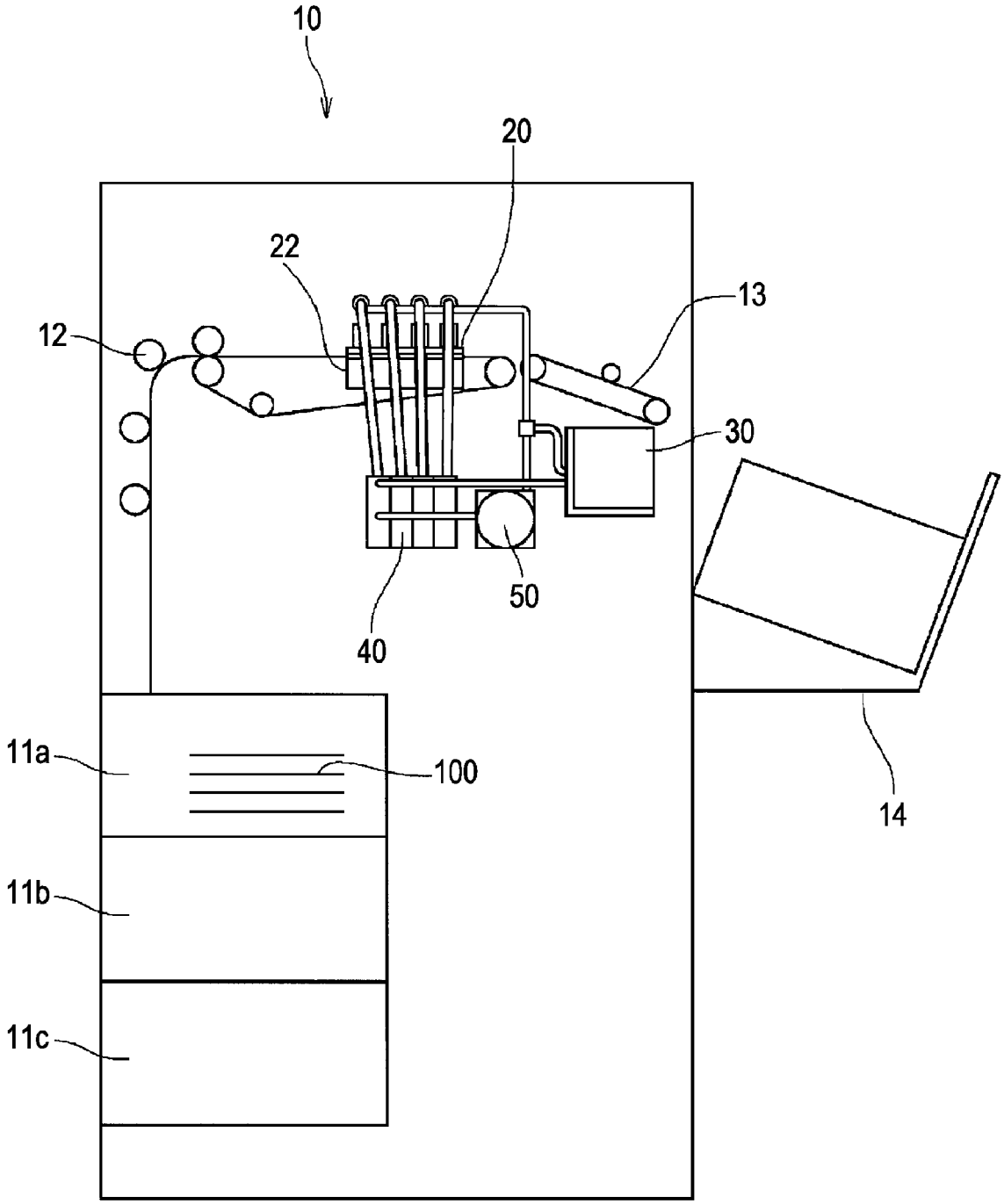
FIG. 1 is a schematic side view of an inkjet printer according to an embodiment of the present invention.

FIG. 1 is a schematic side view of the inkjet printer 10 according to the embodiment of the present invention.

As shown in FIG. 1, the inkjet printer 10 includes sheet-feed trays 11*a*, 11*b*, and 11*c*, a sheet-feed unit 12, the line head 20, a head cap 22, and a sheet-discharge tray 14. The sheet-feed trays 11*a*, 11*b*, and 11*c* separately hold three types of recording sheets 100 having different sizes, respectively. The sheet-feed unit 12 selectively feeds the recording sheets 100 from any one of the sheet-feed trays 11*a*, 11*b*, and 11*c* in accordance with the size for printing. The line head 20 performs printing on the fed recording sheets 100. The head cap 22 covers and protects an ink discharge surface of the line head 20 when printing is not performed. The sheet-discharge unit 13 discharges the printed recording sheets 100. The sheet-discharge tray 14 holds the discharged recording sheets 100. The head cap 22 can hermetically seal the ink discharge surface of the line head 20 by an opening-closing device (not shown).

Here, the line head 20 discharges ink onto a recording sheet 100 fed so as to oppose the line head 20, and performs printing. In addition, the line head 20 can perform printing up to a width of a largest recording sheet 100 that is fed without moving the head in a widthwise direction of the recording sheet 100. Therefore, compared to a serial head that performs printing by moving the head in the widthwise direction of the recording sheet 100, not only is vibration and noise reduced, but also printing speed can be considerably increased.

In addition, the inkjet printer 10 according to the embodiment is a separate head type to which an ink cartridge 30 (corresponding to a liquid tank in the present invention), which is provided separately from the line head 20, is mounted. The ink cartridge 30, separately, stores the ink in accordance with the four colors (Y, M, C, and K) of the ink, supplied to the line head 20, and is removably mounted to the inkjet printer 10. Therefore, when all the ink in the ink cartridge 30 is consumed, it is possible to quickly replace the ink cartridge 30 with another ink cartridge.

Further, a subtank 40 (corresponding to an auxiliary tank in the present invention) is disposed between the line head 20 and the ink cartridge 30 prior to supplying the ink to the line head 20. The subtank 40 temporarily stores the ink at a position below the line head 20, and applies a certain negative pressure based on a water head difference to the ink in the line head 20. Therefore, not only is it possible to prevent the ink from leaking from the line head 20, but also it is possible to hold the ink so that it can be stably discharged.

Further, a transfer pump 50 for transferring the ink stored in the ink cartridge 30 is disposed between the ink cartridge 30 and the subtank 40. If driving of the transfer pump 50 is controlled by a controlling device (not shown), the ink (Y, M, C, and K) in the ink cartridge 30 is supplied to the line head 20 through the subtank 40.

When printing is performed by such an inkjet printer 10, the sheet-feed unit 12 selectively feeds a recording sheet 100 in accordance with the size for printing from any one of the sheet-feed trays 11*a*, 11*b*, and 11*c*. The head cap 22 is separated from the line head 20, so that the ink discharge surface of the line head 20 is exposed. While moving the recording sheet 100, the ink of each color is discharged towards the recording sheet 100 from the line head 20, and color printing is performed. The recording sheet 100 on which the printing is performed is discharged by the sheet-discharge unit 13, and is placed on the sheet-discharge tray 14.

Figure 2:
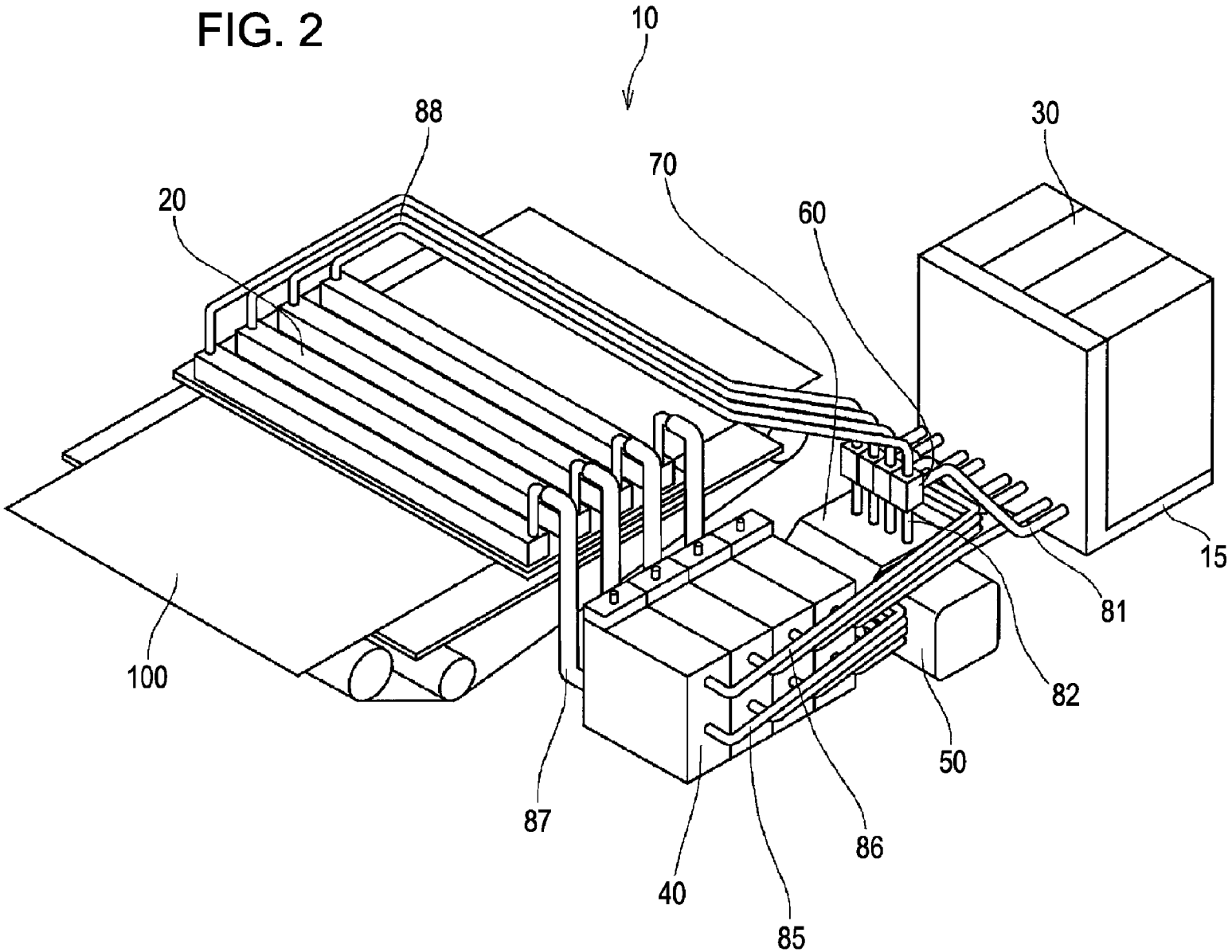
FIG. 2 is a perspective view of a printing section of the inkjet printer according to the embodiment.

FIG. 2 is a perspective view of a printing section of the inkjet printer 10 according to the embodiment.

As shown in FIG. 2, the inkjet printer 10 includes a plurality of the line heads 20 (that is, four line heads 20), a plurality of the ink cartridges 30 (that is, four ink cartridges 30), a plurality of the subtanks 40 (that is, four subtanks 40), and a plurality of the transfer pumps 50 (that is, four transfer pumps 50) in accordance with the types (Y, M, C, and K) of the ink that is discharged. The inkjet printer 10 further includes a plurality of return pipes 86 (that is, four return pipes 86), a plurality of supply pipes 87 (that is, four supply pipes 87), and a plurality of discharge pipes 88 (that is, four discharge pipes 88). The return pipes 86 are disposed so that the inks return to the respective ink cartridges 30 from the respective subtanks 40. The supply pipes 87 are disposed so that the inks transferred by the respective transfer pumps 50 are supplied to the line heads 20. The discharge pipes 88 are disposed so that ink that is not consumed by the line heads 20 is discharged from the line heads 20. The inkjet printer 10 further includes a plurality of three-way valves 60 (that is, four three-way valves 60) and a plurality of check valve arrays 70 (that is, four check valve arrays 70). The three-way valves 60 can switch between flow paths extending towards the respective transfer pumps 50 from the respective ink cartridges 30 and flow paths extending towards the respective transfer pumps 50 from the respective discharge pipes 88. The check valve arrays 70 can change the transfer paths of the respective inks.

Here, the length of each line head 20 corresponds to the width of a recording sheet 100. The inks of the four colors (Y, M, C, and K) are discharged from the respective line heads 20. The inks of the respective colors are supplied to the respective line heads 20 from the respective ink cartridges that separately store the inks of the four colors (Y, M, C, and K). More specifically, the ink cartridges 30 are removably mounted to a movable base 15 (corresponding to a tank mounting section in the present invention) to which transfer pipes 81 (provided in correspondence with the four colors of the inks) are connected. Each transfer pipe 81 is connected to one of the entrance sides of the corresponding three-way valve 60.

Since transfer pipes 82 are connected to exit sides of the respective three-way valves 60, the inks of the respective ink cartridges 30 are transferred to the respective subtanks 40 through the respective check valve arrays 70, the respective transfer pumps 50, and the respective transfer pipes 85. Further, the inks transferred to and temporarily stored in the respective subtanks 40 are supplied to the respective line heads 20 through the respective supply pipes 87. When the amounts of the inks stored in the respective subtanks 40 become greater than or equal to certain amounts, the inks are returned to the respective ink cartridges 30 by the respective return pipes 86 connected to the removable base 15.

In this way, the inkjet printer 10 according to the embodiment includes, for example, the ink cartridges 30, the transfer pipes 81, the three-way valves 60, the transfer pipes 82, the check valve arrays 70, the transfer pumps 50, the transfer pipes 85, the subtanks 40, the supply pipes 86, the line heads 20, and the return pipes 86, in accordance with the colors (Y, M, C, and K) of the inks that are discharged. The transfer pumps 50 cause the inks in the ink cartridges 30 to be supplied to the line heads 20 through the subtanks 40, and to be discharged towards a recording sheet 100.

Ink that is not discharged from the line heads 20 is returned to the subtanks 40 through the discharge pipes 88 by the transfer pumps 50. That is, since each discharge pipe 88 is connected to the other entrance side of its corresponding three-way valve 60, when the ink is supplied to each line head 20 by its corresponding three-way valve 60, the corresponding three-way valve 60 switches to the flow path extending from the ink cartridge 30 towards the corresponding transfer pump 50. In contrast, when the ink is discharged from each line head 20, the corresponding three-way valve 60 switches to the flow path extending from the discharge pipe 88 towards the corresponding transfer pump 50. Therefore, the inkjet printer 10 according to the embodiment can not only supply the inks to the line heads 20 from the ink cartridges 30, but also can remove air bubbles included in the inks by discharging the inks from the line heads 20 and circulating the inks through the subtanks 40.

Figure 3:
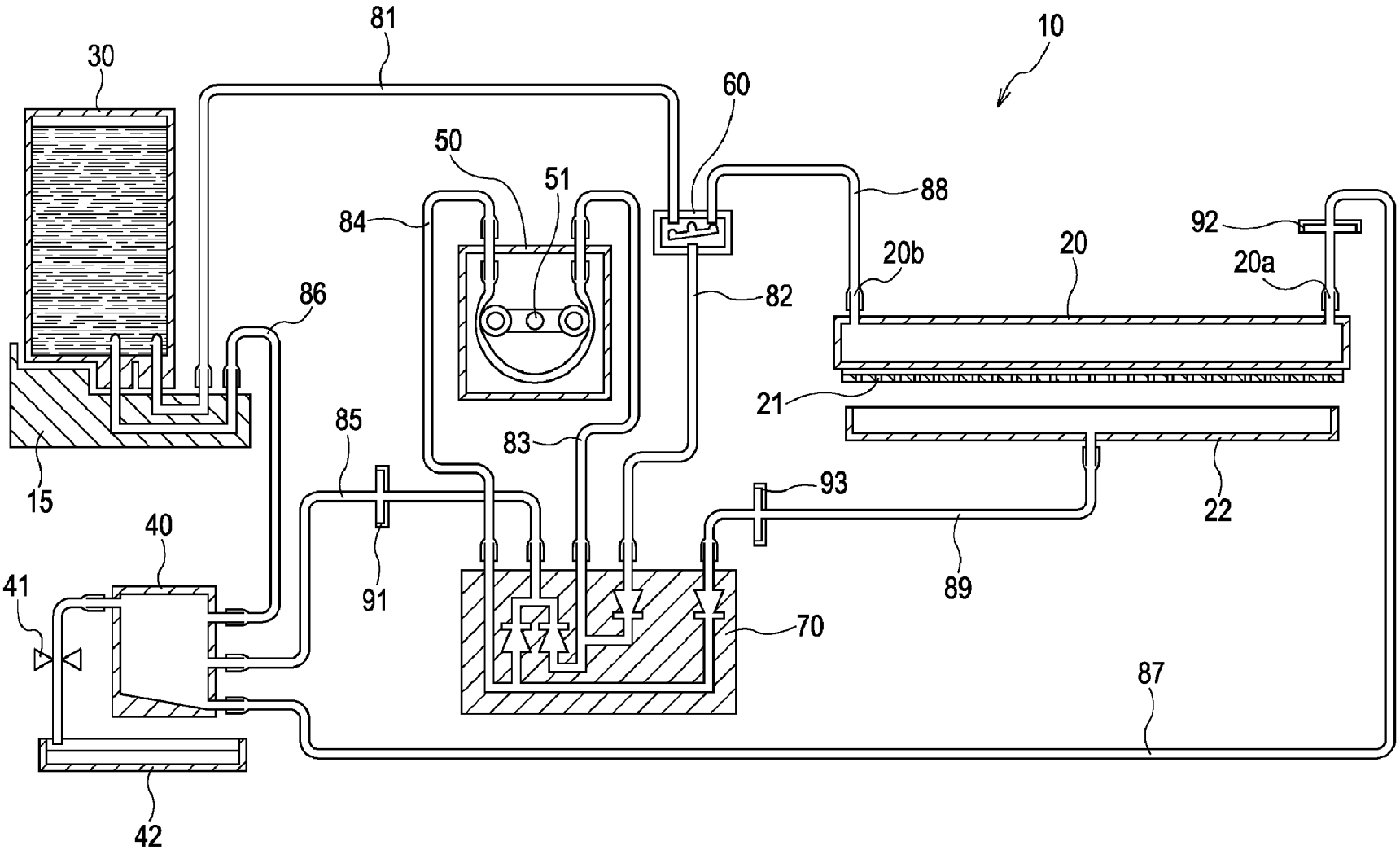
FIG. 3 is a conceptual diagram of a piping system for one color of the printing section of the inkjet printer according to the embodiment.

FIG. 3 is a conceptual diagram of a piping system for one color of the printing section of the inkjet printer 10 according to the embodiment.

As shown in FIG. 3, the inkjet printer 10 includes the line head 20, the ink cartridge 30, the subtank 40, the transfer pump 50, the three-way valve 60, and the check valve array 70. These component parts are provided for the inks of the four colors (Y, M, C, and K), respectively. However, the transfer pumps 50 are driven at the same time by one common driving motor 51 (corresponding to a driving source in the present invention). More specifically, each transfer pump 50 is a tube pump, and the inks can be transferred by continuously resiliently deforming the resilient tubes of the respective transfer pumps 50 by the one driving motor 51. The tree-way valves 60 can be switched by one common operating source (not shown). Therefore, the inkjet printer 10 can be small and inexpensive.

The transfer pipes 81 connect the ink cartridges 30 and the respective three-way valves 60 to each other through the removable base 15. The transfer pipes 82 connect the three-way valves 60 and the respective check valve arrays 70 to each other. The transfer pipes 83 and the transfer pipes 84 connect the check valve arrays 70 and the respective transfer pumps 50 to each other. Further, the transfer pipes 85 having filters 91 connect the check valve arrays 70 and the respective subtanks 40 to each other. Therefore, if the transfer pumps 50 are driven by the driving motor 51, the inks in the ink cartridges 30 can be transferred to the respective subtanks 40.

The subtanks 40 are connected to the respective ink cartridges 30 through the return pipes 86 and the removable base 15, and are connected to supply ports 20*a* of the respective line heads 20 by the supply pipes 87 having filters 92. Therefore, using the transfer pumps 50, the inks in the subtanks 40 can be returned to the ink cartridges 30, and can be supplied to the line heads 20 and discharged from nozzles 21. The subtanks 40 are provided with atmospheric open valves 41 for opening their interiors to the atmosphere. Any ink leaking through the atmospheric open valves 41 is stored in a waste ink reservoir 42.

At a side opposite to the supply ports 20*a* of the line heads 20, discharge ports 20*b* are provided. The discharge ports 20*b* and the three-way valves 60 are connected to each other by the discharge pipes 88. Therefore, the three-way valves 60 switch to the line head 20 sides, and air bubbles in the inks in the line heads 20 are discharged along with the inks from the discharge ports 20*b* and are circulated between the discharge ports 20*b* and the subtanks 40. This makes it possible to remove the air bubbles from the inks.

Further, the head caps 22, disposed so as to oppose the line heads 20, are connected to the check valve arrays 70 by discharge pipes 89 having filters 93. Therefore, if the inks containing the air bubbles are sucked towards the head caps 22 from the nozzles 21 of the line heads 20, it is possible to discharge the air bubbles near the nozzles 21 along with the inks, and to remove the air bubbles at the subtanks 40.

Figure 4A:
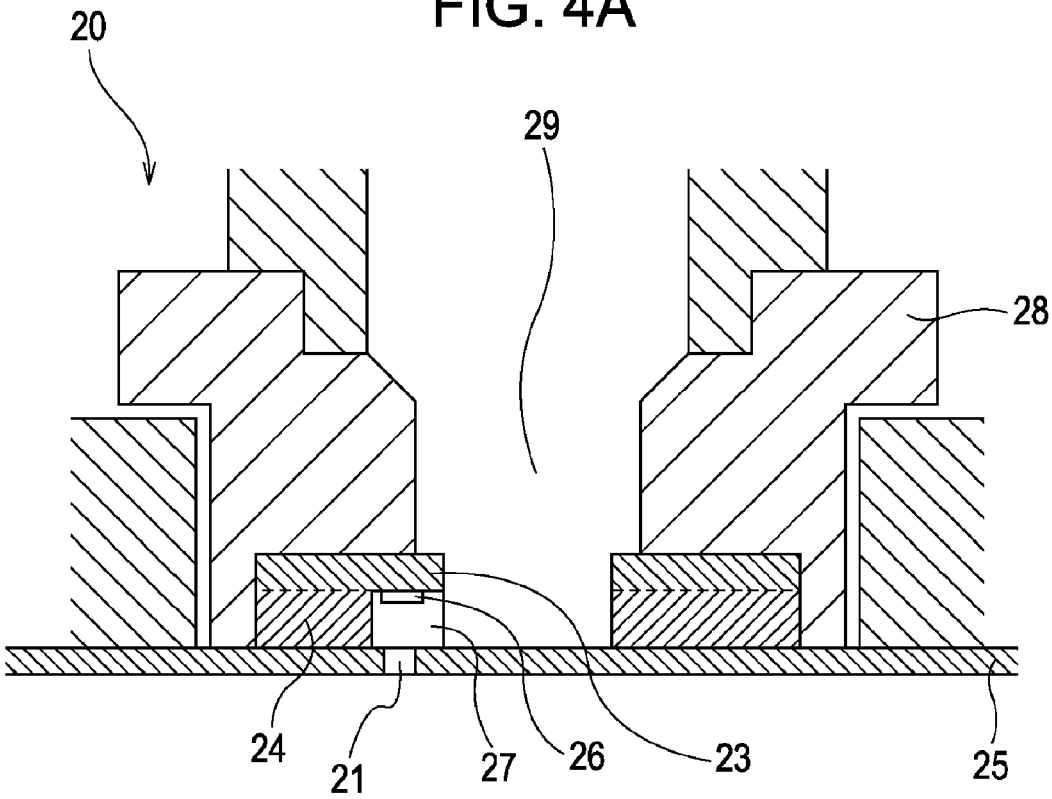
FIGS. 4A and 4B are a partial sectional view and a partial perspective view of a line head.
Figure 4B:
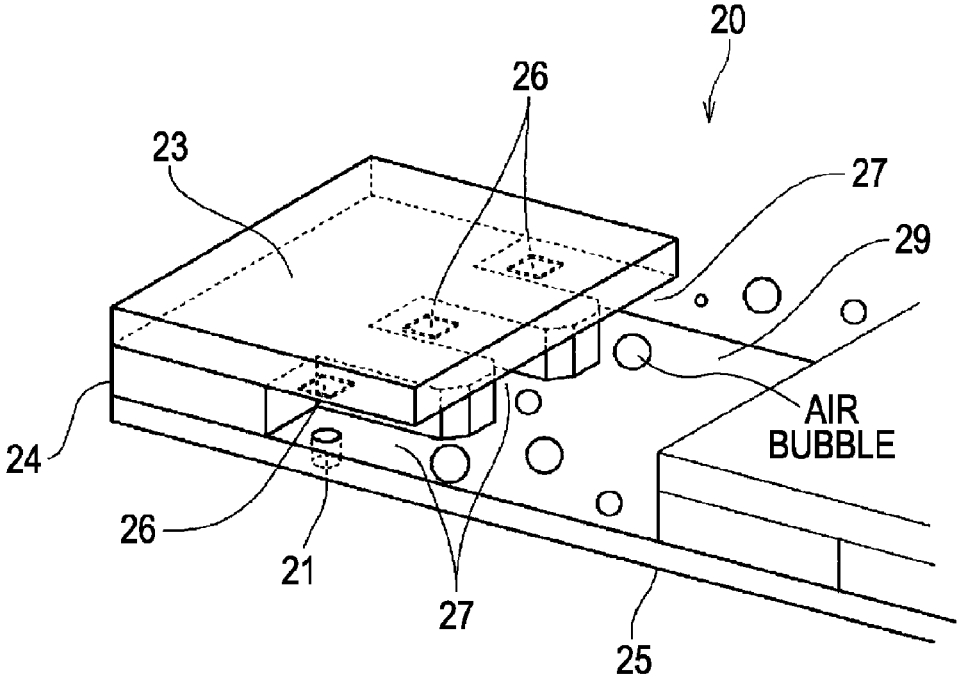

FIGS. 4A and 4B are a partial sectional view and a partial perspective view of the line head 20.

As shown in FIG. 4, the line head 20 is formed by placing a barrier layer 24 with respect to a semiconductor substrate 23, and adhering a nozzle sheet 25 (provided with the nozzles 21) to the barrier layer 24. In addition, a plurality of heating resistors 26 are formed on the semiconductor substrate 23 in one direction at certain intervals by deposition, and the semiconductor substrate 23, the barrier layer 24, and the nozzle sheet 25 (which surround the heating resistors 26) constitute ink liquid chambers 27.

At the upper side of the semiconductor substrate 23, a common flow path member 28 is disposed. A common ink flow path 29, formed by the common flow path member 28, communicates with all of the ink liquid chambers 27. Therefore, the inks in the subtanks 40 (see FIG. 3) are supplied to all of the ink liquid chambers 27 through the ink flow path 29. When a pulsed electric current is caused to flow to the heating resistors 26 during a short time (such as from 1 to 3 μsec), the heating resistors 26 are rapidly heated. As a result, the air bubbles in the inks are generated at portions contacting the heating resistors 26, so that the inks having predetermined volumes are pushed away by expansions of the air bubbles (that is, the inks are boiled). By this, ink having a volume that is the same as that of the ink that has been pushed away is discharged as ink drops from the nozzles 21.

Accordingly, since the line heads 20 discharge ink by generating air bubbles by heat, air bubbles tend to mix with the ink (see FIG. 4B). When ink is initially supplied, air existing in, for example, the ink flow path 29 of each line head 20 mixes with ink, so that air bubbles are mixed with the ink. When the air bubbles exist in the ink in the ink liquid chambers 27, discharging force of the ink is reduced by compressibility of the gas. Therefore, a disturbance occurs in an ink discharge direction. When the air bubbles in the ink expand due to, for example, a temperature change caused by ink discharge (heating of the heating resistors 26), the ink in the ink liquid chambers 27 may freely leak from the nozzles 21.

To overcome this problem, as shown in FIG. 3, the inkjet printer 10 according to the embodiment removes relatively large air bubbles included in the ink in the line heads 20 by circulating the ink included in the line heads 20 through the discharge pipes 88. By sucking the ink towards the head caps 22 from the nozzles 21, relatively small air bubbles existing near the nozzles 21 are discharged along with the ink, and these are circulated through the discharge tubes 89 to remove the air bubbles. The check valve arrays 70 switch between circulation of ink through the discharge pipes 88, the three-way valves 60, and the transfer pipes 82 and circulation of ink through the discharge pipes 89.

Figure 5:
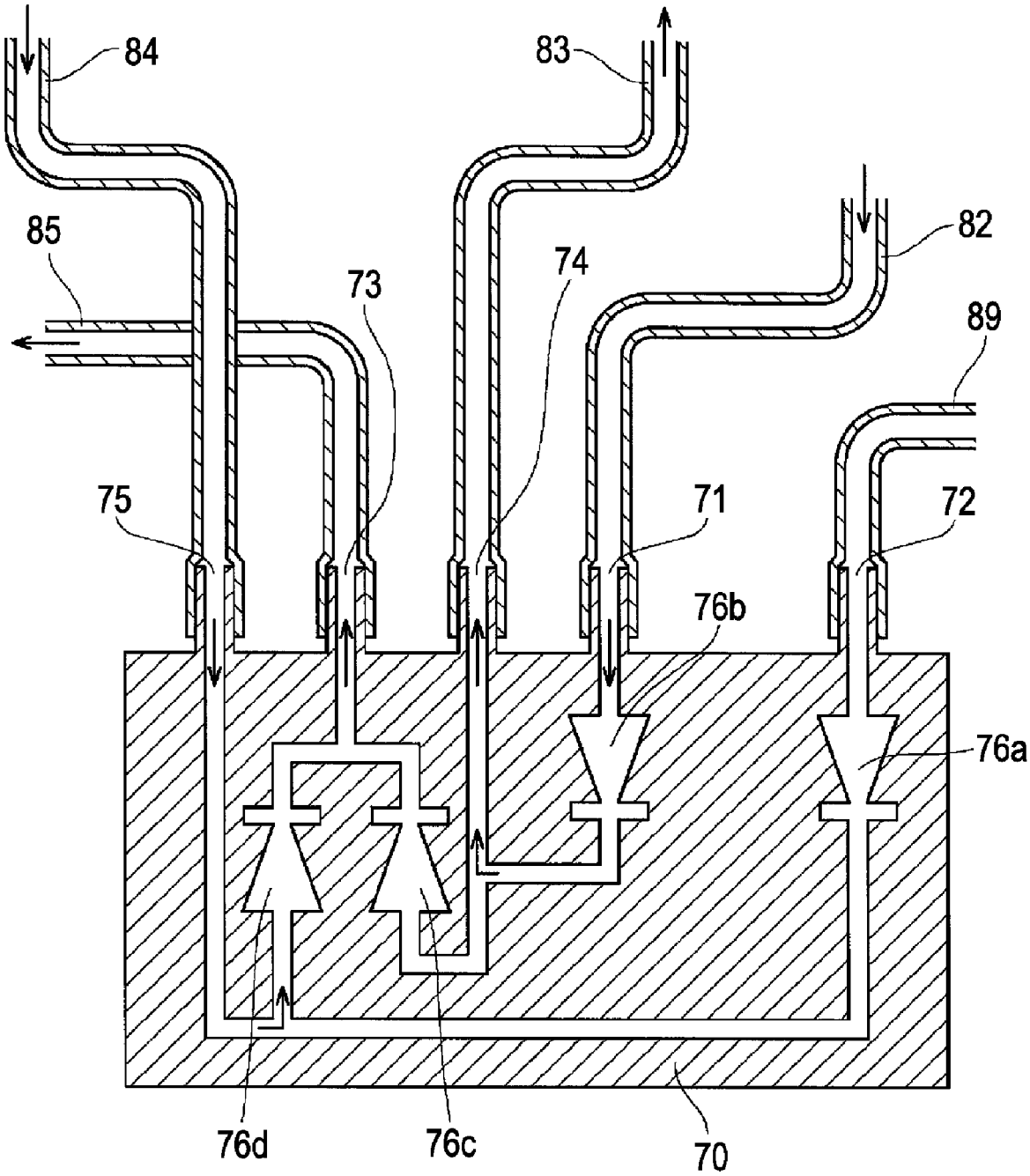
FIG. 5 is a sectional view of a check valve array of the inkjet printer according to the embodiment, and shows a state in which ink is circulated in the line head.

FIG. 5 is a sectional view of the check valve array 70 of the inkjet printer 10 (see FIG. 3) according to the embodiment, and shows a state in which ink is circulated in the line head 20 (see FIG. 3).

Figure 6:
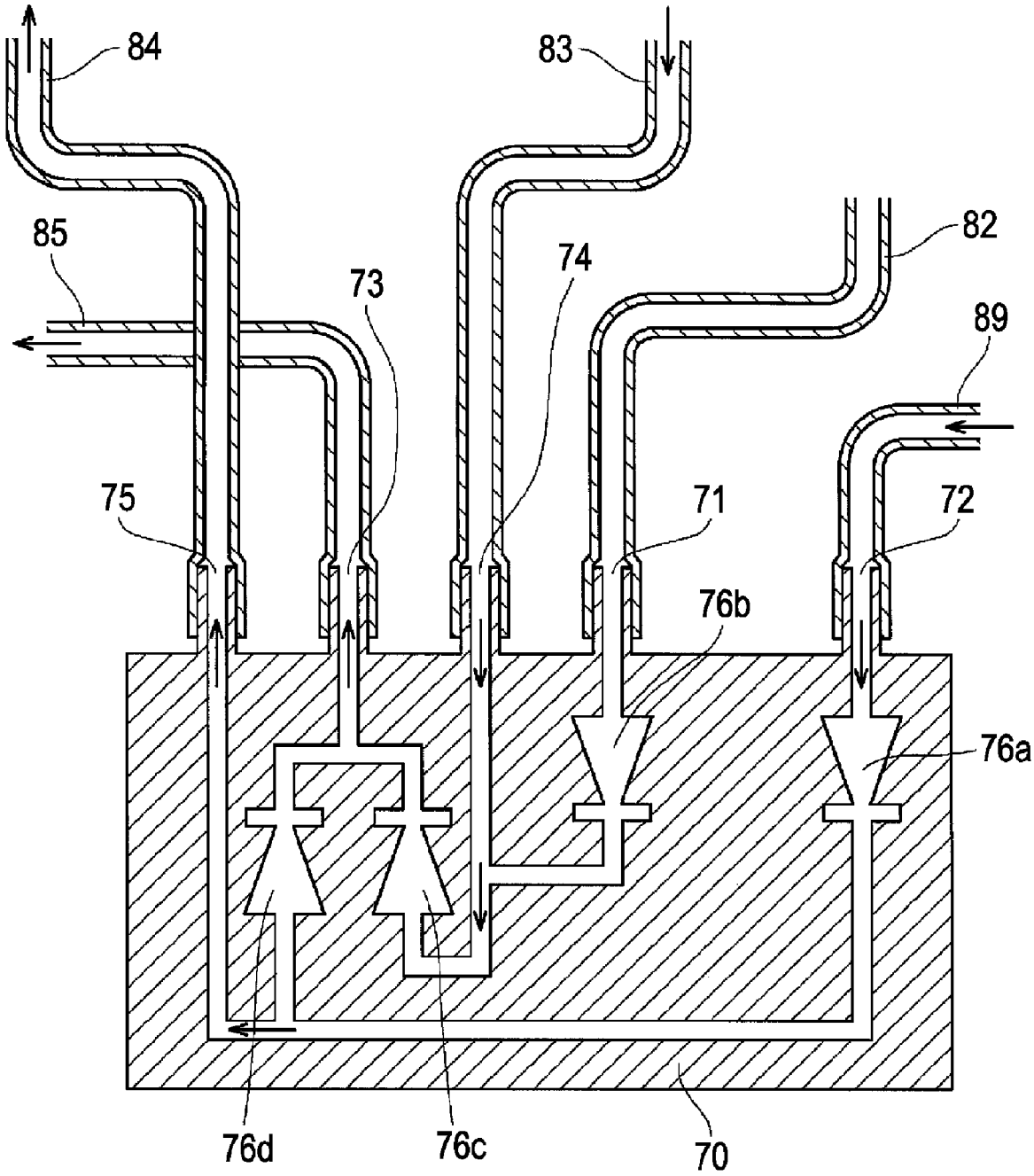
FIG. 6 is a sectional view of the check valve array of the inkjet printer according to the embodiment, and shows a state in which the ink sucked to a head cap is circulated.

FIG. 6 is a sectional view of the check valve array 70 of the inkjet printer 10 according to the embodiment, and shows a state in which ink sucked to the head cap 22 (see FIG. 3) is circulated.

As shown in FIGS. 5 and 6, the check valve array 70 includes a first entrance 71, which is an entrance for ink and which has the transfer pipe 82 connected thereto, and a second entrance 72, which is another entrance for ink and which has the discharge pipe 89 connected thereto. The check valve array 70 also includes a first exit 73, which is an exit for ink and which has the transfer pipe 85 (connected to the subtank 40 (see FIG. 3)) connected thereto. Further, the check valve array 70 includes a pump connection port 74, to which the transfer pipe 83 (connected to the transfer pump 50 (see FIG. 3)) is connected, and a pump connection port 75, to which the transfer pipe 84 (connected to the transfer pump 50) is connected.

Such a check valve array 70 includes four check valves 76*a*, 76*b*, 76*c*, and 76*d*. Each of the check valves 76*a*, 76*b*, 76*c*, and 76*d* unidirectionally pass ink therethrough, and a reverse flow is stopped by resistance. Therefore, as shown in FIGS. 5 and 6, the check valves 76*a* and 76*b* pass ink therethrough only from an upper side to a lower side; and the check valves 76*c* and 76*d* pass ink therethrough only from a lower side to an upper side.

Here, when the driving motor 51 shown in FIG. 3 is rotated in a direction CW (clockwise), the resilient tube in the transfer pump 50 is continuously resiliently deformed in the direction CW. Therefore, the ink in the transfer pipe 83 is transferred as indicated by an upwardly facing arrow shown in FIG. 5, and the ink in the transfer pipe 84 is transferred as indicated by a downwardly facing arrow shown in FIG. 5. In the embodiment, the transfer of the ink in the direction CW by the transfer pump 50 is in a forward direction.

Therefore, a transfer path where the ink is sucked out from the pump connection port 74, and, by the orientations of the check valve 76*b* and the check valve 76*b*, the ink flows towards the pump connection port 74 through the transfer pipe 82, the first entrance 71, and the check valve 76*b* is formed. In addition, a transfer path where the ink is pushed into the pump connection port 75, and, by the orientations of the check valve 76*a* and the check valve 76*d*, the ink flows towards the transfer pipe 85 through the pump connection port 75, the check valve 76*d*, and the first exit 73 is formed.

When the driving motor 51 shown in FIG. 3 is rotated in a direction CCW (counterclockwise), the resilient tube in the transfer pump 50 is continuously resiliently deformed in the direction CCW. Therefore, the ink in the transfer pipe 83 is transferred as indicated by a downwardly facing arrow shown in FIG. 6, and the ink in the transfer pipe 84 is transferred as indicated by an upwardly facing arrow shown in FIG. 6. In the embodiment, the transfer of the ink in the direction CCW by the transfer pump 50 is in a reverse direction.

Therefore, a transfer path where the ink is sucked out from the pump connection port 75, and, by the orientations of the check valve 76*a* and the check valve 76*d*, the ink flows towards the pump connection port 75 through the discharge pipe 89, the second entrance 72, and the check valve 76*a* is formed. In addition, a transfer path where the ink is pushed into the pump connection port 74, and, on the basis of the orientations of the check valve 76*b* and the check valve 76*c*, the ink flows towards the transfer pipe 85 through the pump connection port 74, the check valve 76*c*, and the first exit 73 is formed.

In this way, in the check valve array 70, it is possible to form a transfer path extending towards the same exit (first exit 73) from a different entrance (first entrance 71 or the second entrance 72) by only switching between transfer of the ink in the direction CW and transfer of the ink in the direction CCW by one transfer pump 50. More specifically, in the check valve array 70, when the ink is transferred in the forward direction by the transfer pump 50, the ink transfer path is changed so that the ink enters the first entrance 71 from the transfer pipe 82 connected to the line head 20 (see FIG. 3), exits from the first exit 73, and is transferred towards the transfer pipe 85 connected to the subtank 40 (see FIG. 3). This makes it possible for the ink in the line head 20 to circulate through the subtank 40.

In contrast, when the ink is transferred in the reverse direction by the transfer pump 50, in the reverse valve array 70, the ink transfer path is changed so that the ink enters the second entrance 72 from the transfer pipe 89 connected to the head cap 22 (see FIG. 3), exits from the first exit 73, and is transferred towards the transfer pipe 85 connected to the subtank (see FIG. 3). This makes it possible for the ink sucked to the head cap 22 to circulate through the subtank 40.

By switching the three-way valve 60 (see FIG. 3), the transfer pipe 82 is also connected to the ink cartridge 30 (see FIG. 3). Therefore, when the ink is transferred in the forward direction by the transfer pump 50, it is possible to change the ink transfer path so that the ink stored in the ink cartridge 30 enters the first entrance 71, exits from the first exit 73, and is transferred towards the transfer pipe 85. This makes it possible to fill the subtank 40 (see FIG. 3) with the ink in the ink cartridge 30. The subtank 40 is filled with ink when starting to use the inkjet printer 10 (see FIG. 3) or when replenishing the subtank 40 with ink.

Figure 7:
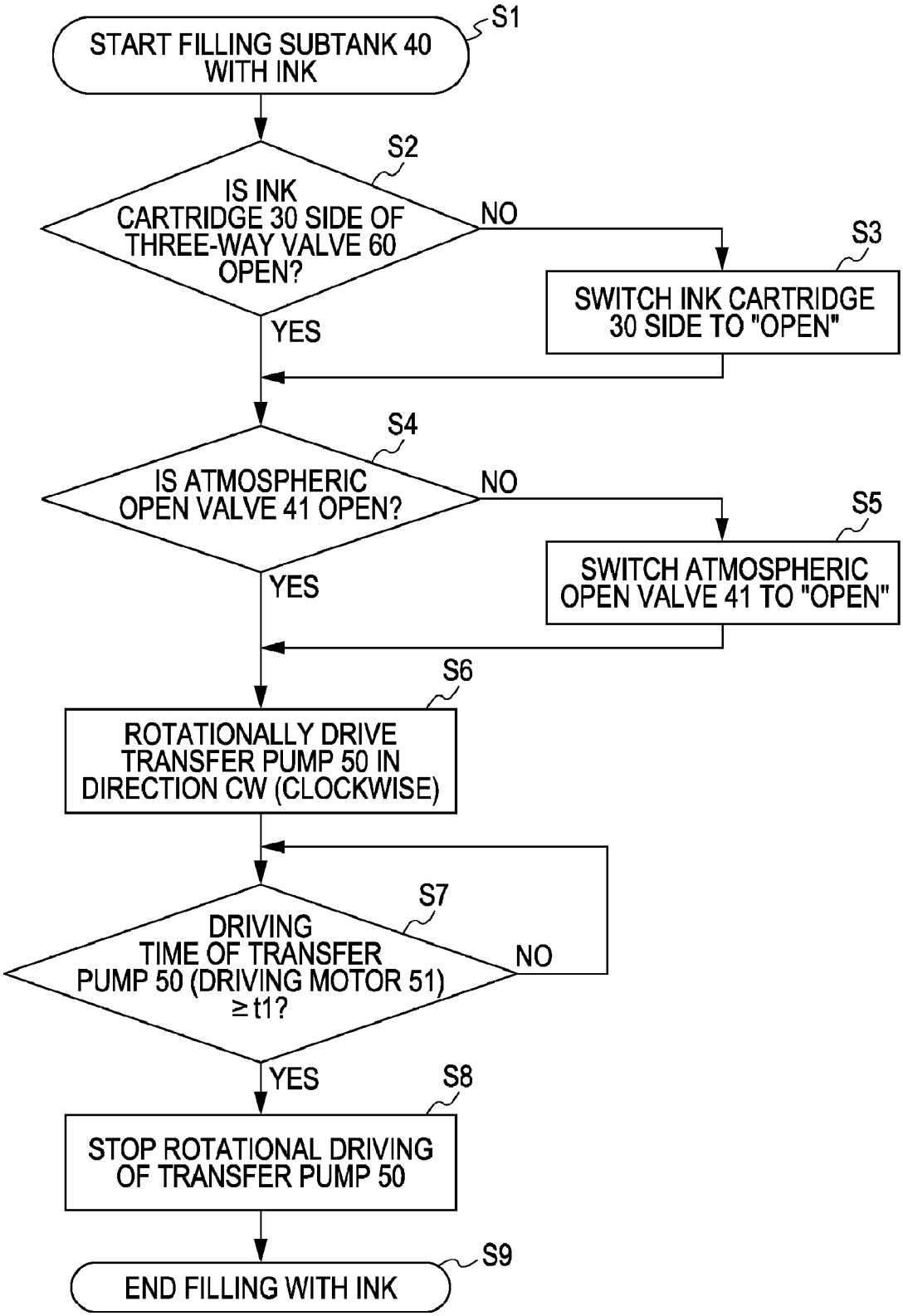
FIG. 7 is a flowchart for filling a subtank with ink in the inkjet printer according to the embodiment.

FIG. 7 is a flowchart for filling the subtank 40 with ink in the inkjet printer 10 (see FIG. 3) according to the embodiment.

Figure 8:
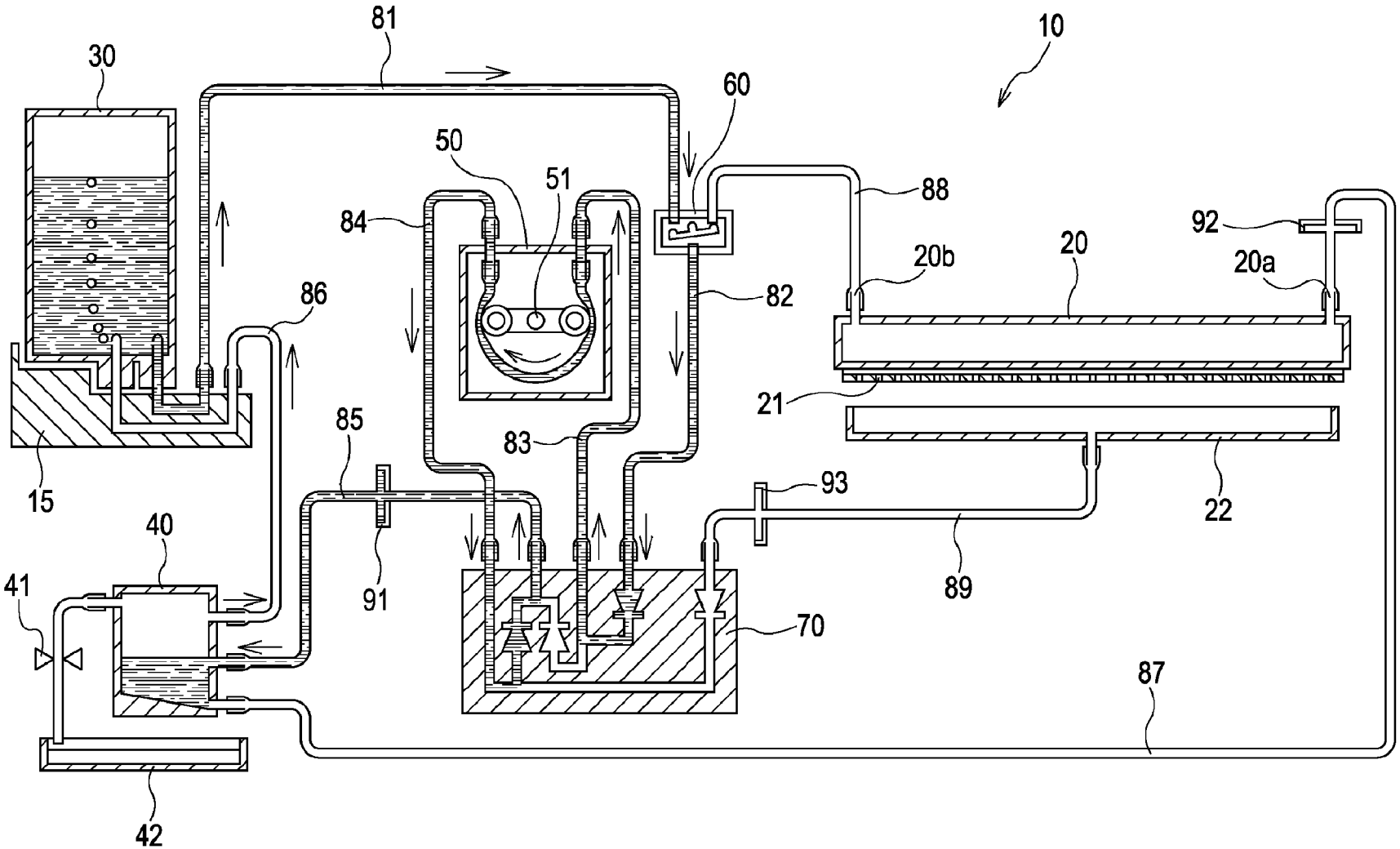
FIG. 8 is a conceptual diagram of the piping system for one color of the printing section of the inkjet printer according to the embodiment, and shows a state in which the subtank is being filled with ink.

FIG. 8 is a conceptual diagram of the piping system for one color of the printing section of the inkjet printer 10 according to the embodiment, and shows a state in which the subtank 40 is being filled with ink.

Figure 9:
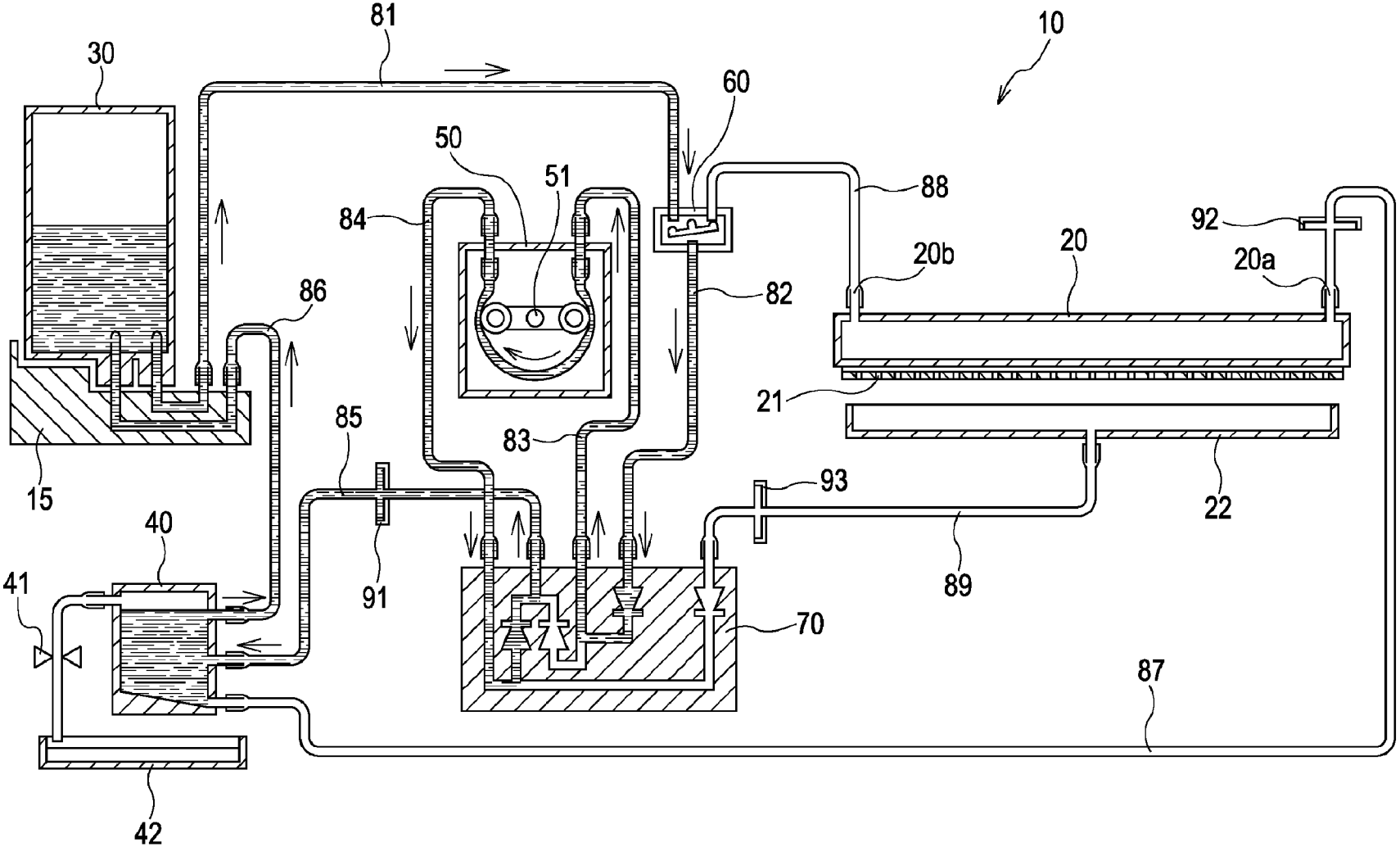
FIG. 9 is a conceptual diagram of the piping system for one color of the printing section of the inkjet printer according to the embodiment, and shows a state in which the filling of the subtank with the ink ends.

FIG. 9 is a conceptual diagram of the piping system for one color of the printing section of the inkjet printer 10 according to the embodiment, and shows a state in which the filling of the subtank 40 with the ink ends.

When, in Step S1 shown in FIG. 7, filling of the subtank 40 with ink is started, then, in Step S2, it is detected whether or not an ink cartridge 30 side of the three-way valve 60 is open. If it is not open, the process is branched to Step S3 to switch the state of the ink cartridge 30 side to an open state. The three-way valve 60 shown in FIGS. 8 and 9 is in a state in which the ink cartridge 30 side is open.

If the ink cartridge 30 side of the three-way valve 60 is open, the process proceeds to Step S4, and it is detected whether or not the atmospheric open valve 41 of the subtank 40 is open. If it is not open, the process is branched to Step S5 to switch the state of the atmospheric open valve 41 to an open state. The atmospheric open valve 41 shown in FIGS. 8 and 9 is in the open state.

In this way, after opening the ink cartridge 30 side of the three-way valve 60, and opening the atmospheric open valve 41, the transfer pump 50 is rotationally driven in the direction CW (clockwise) in Step S6. The transfer pump 50 shown in FIGS. 8 and 9 is in a state in which it is rotationally driven in the direction CW (clockwise) by the driving motor 51 that is controlled by a controlling device (not shown).

When the transfer pump 50 is rotationally driven in the direction CW (clockwise), ink is transferred in the forward direction (the direction CW) as indicated by the arrow in the transfer pump 50 shown in FIG. 8. By this, the ink stored in the ink cartridge 30, mounted to the removable base 15, is transferred to and stored in the subtank 40 through the transfer pipe 81, the three-way valve 60, the transfer pipe 82, the check valve array 70, the transfer pipe 83, the transfer pump 50, the transfer pipe 84, the check valve array 70, the transfer pipe 85, and the filter 91. When, for example, foreign matter is mixed in the transferred ink, the foreign matter is removed by the filter 91 prior to being stored in the subtank 40.

When the transferred ink is stored in the subtank 40, the height of the liquid surface of the ink in the subtank 40 is gradually increased. The internal pressure in the ink cartridge 30 is reduced due to the transfer of the ink. Therefore, air in the subtank 40 is sucked to the ink cartridge 30 through the return pipe 86. Since the atmospheric open valve 41 is open, the internal pressure of the ink cartridge 30 is maintained at an internal pressure (atmospheric pressure) that is the same as that in the subtank 40.

When the height of the liquid surface of the ink in the subtank 40 reaches the entrance of the return pipe 86, the return pipe 86 is stopped by the ink as shown in FIG. 9. This prevents the ink cartridge 30 from sucking air from the return pipe 86. However, this time, the ink cartridge 30 sucks the ink in the subtank 40. Even if the transfer of the ink by the transfer pump 50 in the forward direction is continued in this state, ink that is of the same amount as the ink transferred from the ink cartridge 30 to the subtank 40 is returned to the ink cartridge 30 from the subtank 40 by the return pipe 86. Therefore, the ink in the subtank 40 is maintained at a certain state corresponding to a full state of the subtank 40 (corresponding to the state in which the height of the liquid surface is that shown in FIG. 9). Any ink that has leaked out through the atmospheric open valve 41 in the open state is accumulated in the discharge ink reservoir 42.

Here, a driving time t1 of the transfer pump 50 (driving motor 51) is a sufficient time up to when the ink returns to the ink cartridge 30 from the subtank 40 by the return pipe 86 after filling the empty subtank 40 with the ink in the ink cartridge 30. Then, in Step S7 shown in FIG. 7, it is detected whether or not the driving time $\geqq$t1. If the driving time $\leqq$t1, the process proceeds to the next Step S8 to stop the rotational driving of the transfer pump 50. By this, the subtank 40 can be reliably made full with ink (corresponding to the state in which the height of the liquid surface is that shown in FIG. 9), and the filling of the subtank 40 with ink ends in Step S9.

When the subtank 40 is filled with the ink in this way, the subtank 40 is set in the state corresponding to that when the filling of the ink is ended in FIG. 9. When a user starts using the inkjet printer 10, no ink is supplied into the line head 20. Therefore, the ink stored in the subtank 40 is supplied to the line head 20.

Figure 10:
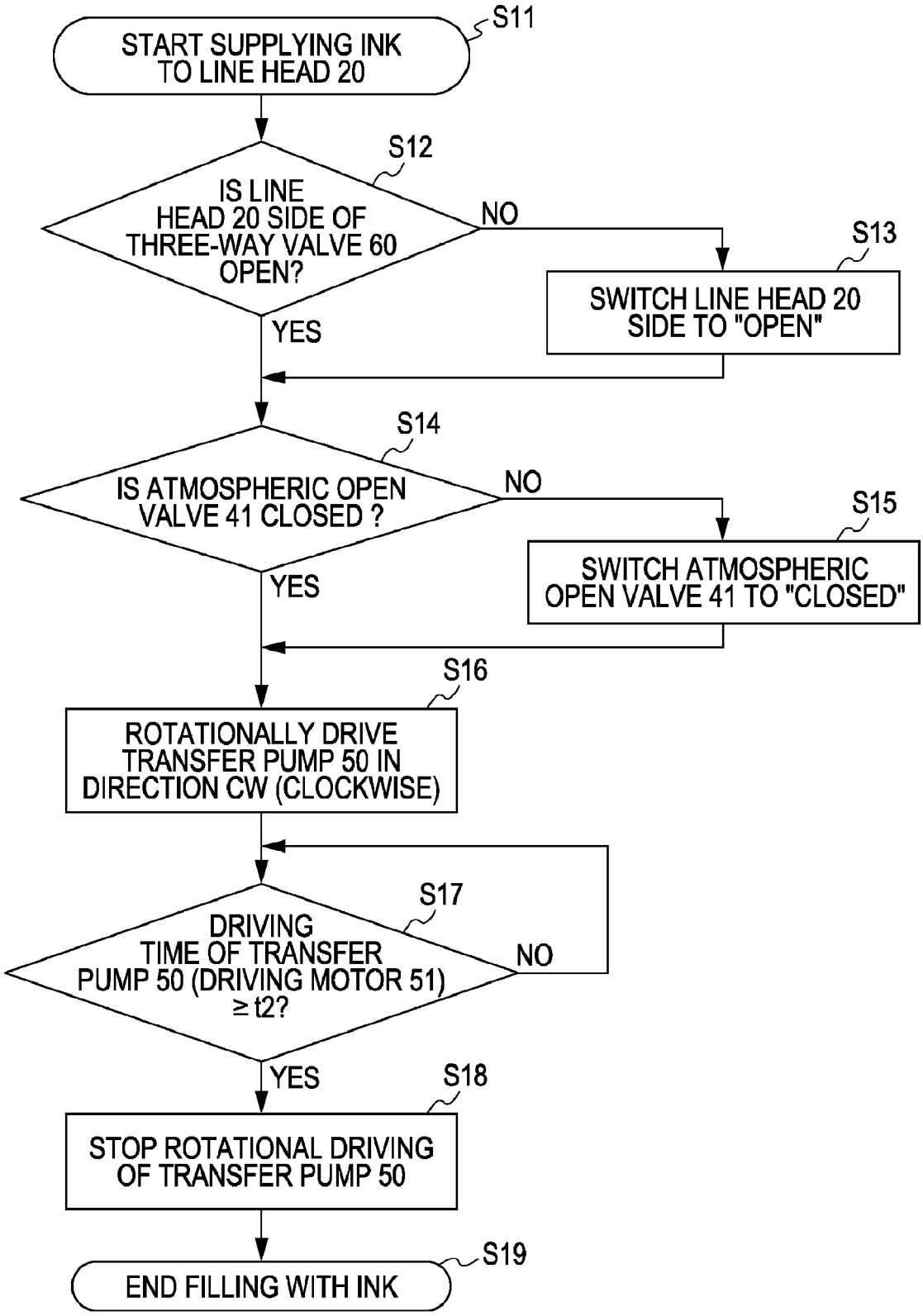
FIG. 10 is a flowchart for supplying the line head with ink in the inkjet printer according to the embodiment.

FIG. 10 is a flowchart for supplying ink to the line head 20 of the inkjet printer 10 (see FIG. 3) according to the embodiment.

Figure 11:
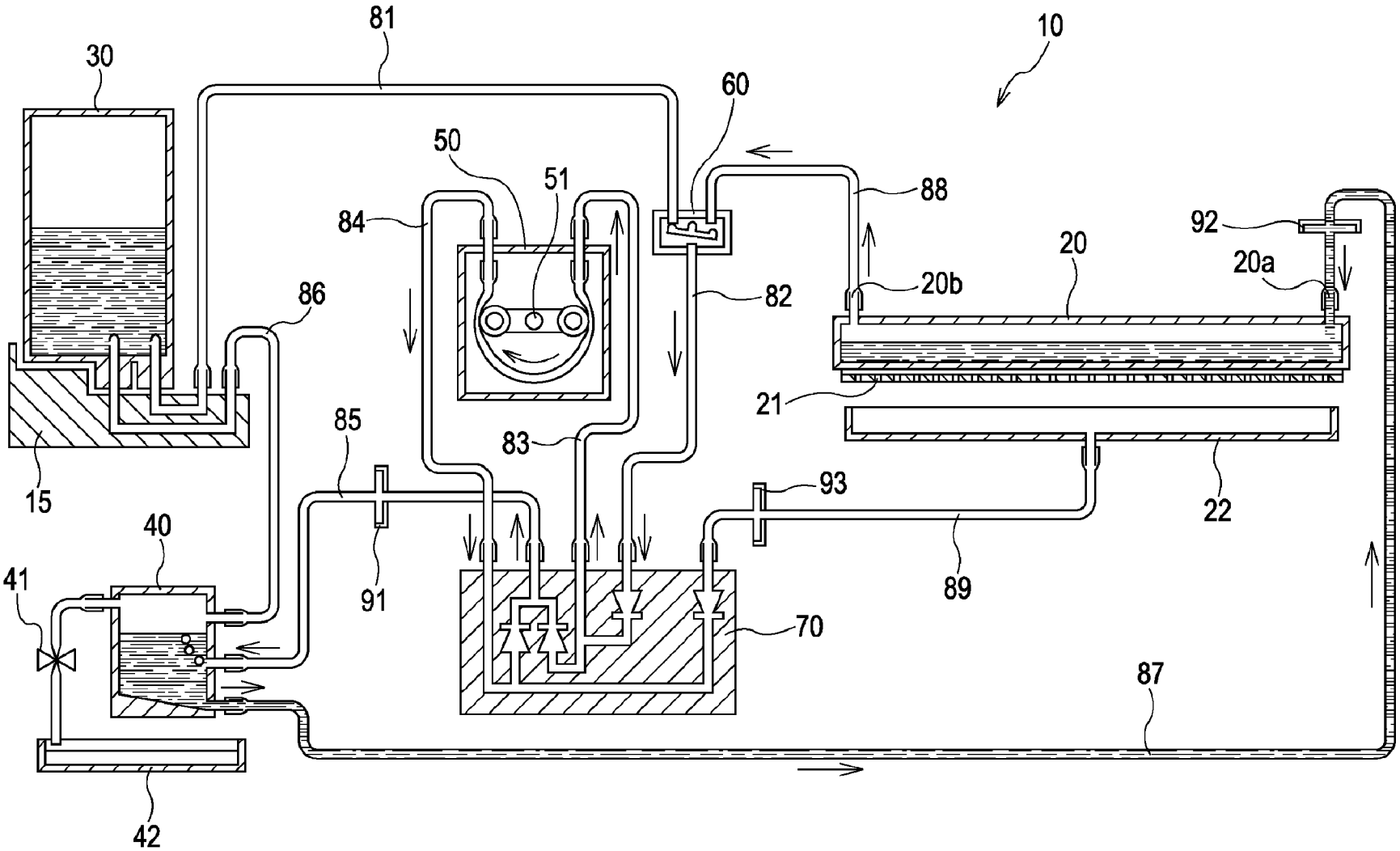
FIG. 11 is a conceptual diagram of the piping system for one color of the printing section of the inkjet printer according to the embodiment, and shows a state in which ink is being supplied to the line head.

FIG. 11 is a conceptual diagram of the piping system for one color of the printing section of the inkjet printer 10 according to the embodiment, and shows a state in which ink is being supplied to the line head 10.

Figure 12:
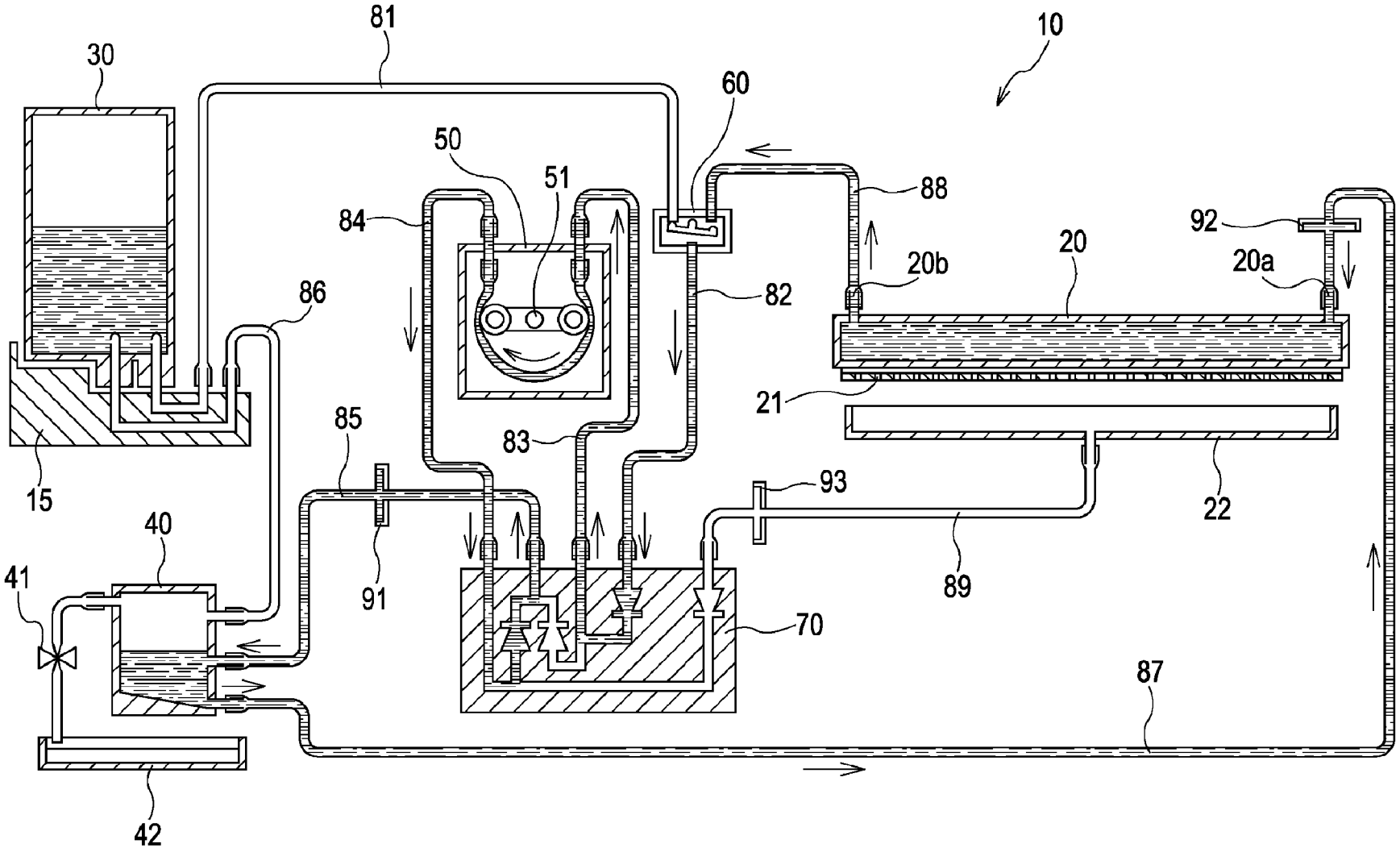
FIG. 12 is a conceptual diagram of the piping system for one color of the printing section of the inkjet printer according to the embodiment, and shows a state in which the supply of the ink to the line head ends.

FIG. 12 is a conceptual diagram of the piping system for one color of the printing section of the inkjet printer 10 according to the embodiment, and shows a state in which the supply of the ink to the line head 20 ends.

When, in Step S11 shown in FIG. 10, the supply of the ink to the line head 20 is started, then, in the next Step S12, it is detected whether or not the line head 20 side of the three-way valve 60 is open. If it is not open, the process is branched to Step S13, and the line head 20 side is switched to an open state. The three-way valve 60 shown in FIGS. 11 and 12 is shown in a state in which the line head 20 side is open.

If the line head 20 side of the three-way valve 60 is open, the process proceeds to Step S14 to detect whether or not the atmospheric open valve 41 of the subtank 40 (see FIGS. 11 and 12) is closed. If it is not closed, the process is branched to Step S15 to switch the state of the atmospheric open valve 40 to a closed state. The atmospheric open valve 41 shown in FIGS. 11 and 12 is shown in the closed state.

In this way, after the line head 20 side of the three-way valve 60 is open, and the atmospheric open valve 41 is closed, the transfer pump 50 is rotationally driven in the direction CW (clockwise) in Step S16. The transfer pump 50 shown in FIGS. 11 and 12 is shown in a state in which it is rotationally driven in the direction CW (clockwise) by the driving motor 51 that is controlled by a controlling device (not shown).

When the transfer pump 50 is rotationally driven in the direction CW (clockwise), air is transferred in the forward direction (that is, the direction CW) as shown by the arrow in the transfer pump 50 shown in FIG. 11. By this, the air in the line head 20 is transferred while sucking the air from the nozzle 21, and is transferred to the subtank 40 as shown by the arrows in FIG. 11 through the discharge pipe 88, the three-way valve 60, the transfer pipe 82, the check valve array 70, the transfer pipe 83, the transfer pump 50, the transfer pipe 84, the check valve array 70, the transfer pipe 85, and the filter 91. Since pressure is applied to the interior of the subtank 40 by the transferred air, the ink is pushed out to the supply pipe 87 connected to the lower portion of the subtank 40.

The ink pushed out to the supply pipe 87 is supplied to the line head 20 from the supply port 20*a* through the filter 92. By this, the line head 20 is made full with the ink, and the nozzle 21 is stopped by the ink. Even if the transfer of the ink by the transfer pump 50 is continued in this state, the ink is continuously supplied while the pressure in the line head 20 is kept at a certain level, without sucking air from the nozzle 21. As a result, the air in the line head 20 is pushed out by the ink, and the pushed out ink is separated from the ink in the subtank 40 (that is, gas liquid separation is performed). When, for example, foreign matter is mixed in the transferred ink, the foreign matter is removed by the filter 92 prior to being supplied to the line head 20.

In the inkjet printer 10 according to the embodiment, $Vs \geqq Vh$ holds, where the volume of the interior of the subtank 40 is Vs, and where the total volume of the interior of the line head 20, the interior of the transfer pump 50, the interior of the supply pipe 87, the interior of the discharge pipe 88, the interior of the transfer pipe 85, the interior of the transfer pipe 84, the interior of the transfer pipe 83, the interior of the check valve array 70, the interior of the transfer pipe 82, and interior of the three-way valve similarly constituting an ink discharge path as with the discharge pipe 88 is Vh. Therefore, if the ink is stored in the subtank 40 once, it is possible to replace the air in the transfer path with ink in a short time by only using the ink in the subtank 40. When the ink pushed out to the supply pipe 87 from the subtank 40 returns to the subtank 40, the ink in the line head 20 circulates through the subtank 40 as shown by the arrows shown in FIG. 12. As a result, the ink in the subtank 40 is kept at a certain level in a predetermined state (that is, a state corresponding to that when the height of the liquid surface is that shown in FIG. 12). Moreover, air bubbles mixed in the ink when supplying the ink are all removed at the subtank 40.

Here, a driving time t2 of the transfer pump 50 (driving motor 51) is a sufficient time up to when the ink circulates between the line head 20 and the subtank 40 after supplying the ink in the subtank 40 to the empty line head 20. Then, in Step S17 shown in FIG. 10, it is detected whether or not the driving time ≧t2. If the driving time ≧t2, the process proceeds to the next Step S18 to stop the rotational driving of the transfer pump 50. By this, it is possible to supply ink to the line head 20 and to remove air (remove air bubbles in the ink), and the supply of the ink ends in Step S19.

After supplying the ink to the line head 20 in this way, the subtank 40 is replenished with ink. More specifically, similarly to Step S1 shown in FIG. 7, the filling (replenishing) of the subtank 40 with ink is started. By performing Steps S2 and S3, the ink cartridge 30 side of the three-way valve 60 is opened. Next, by performing Steps S4 and S5, the atmospheric open valve 41 is opened. Then, in Step S6, the transfer pump 50 is rotationally driven in the direction CW (clockwise), so that the subtank 40 is made full with the ink. This makes it possible to discharge the ink from the nozzle 21 of the line head 20. When the ink is discharged from the nozzle 21, the ink in the subtank 40 is consumed. Therefore, the subtank 40 is continuously replenished with ink.

Therefore, the inkjet printer 10 according to the embodiment can perform ink supply and ink filling (replenishment) with only one transfer pump 50 depending upon a switching state of the three-way valve 60 (that is, whether the line head 20 side is open or whether the ink cartridge 30 side is open). Therefore, it is possible to reduce size and costs. Since it is possible to simplify the transfer path of ink and to reduce the number of pipes, it is possible to enhance reliability.

Figure 13:
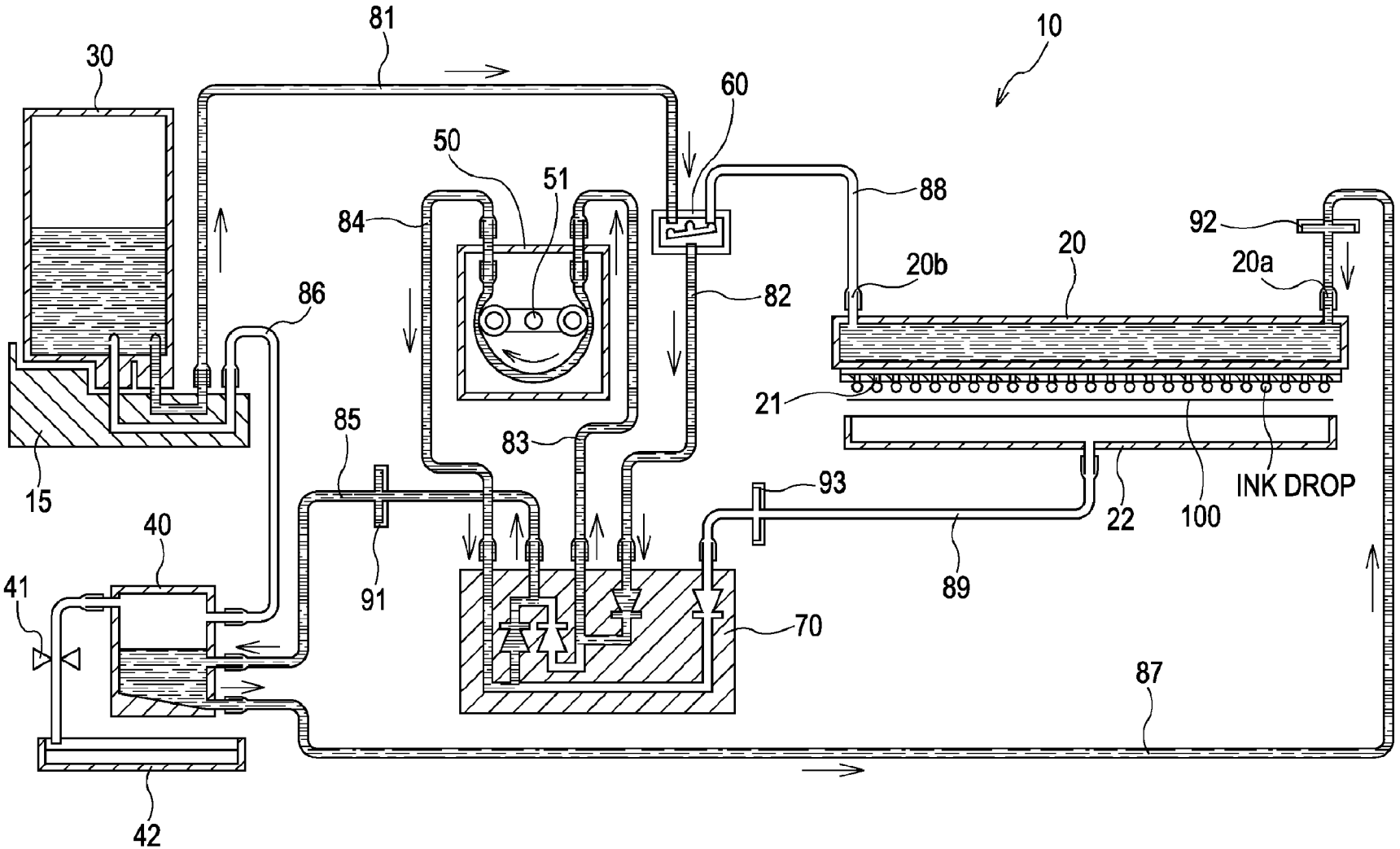
FIG. 13 is a conceptual diagram of the piping system for one color of the printing section of the inkjet printer according to the embodiment, and shows a state in which the line head is being replenished with ink.

FIG. 13 is a conceptual diagram of the piping system for one color of the printing section of the inkjet printer 10 according to the embodiment, and shows a state in which the line head 20 is being replenished with ink.

As shown in FIG. 13, the inkjet printer 10 performs printing by discharging ink drops towards a recording sheet 100 from the nozzle 21 of the line head 20. Therefore, an amount of ink that equivalent to the number of discharged ink drops is supplied to the line head 20 from the subtank 40. The subtank 40 is replenished with ink from the ink cartridge 30.

Here, not only is air separated (or air bubbles in the ink removed) at the subtank 40, but also the subtank 40 applies a certain negative pressure to the ink in the line head 20. More specifically, the subtank 40 is disposed below the nozzle 21 of the line head 20, and temporarily stores the ink at this position. Therefore, if the atmospheric open valve 41 is open, the pressure in the line head 20 is kept at a predetermined negative pressure (a water head differential pressure) generated on the basis of the water head differential pressure corresponding to the height of the liquid surface of the ink in the subtank 40. This prevents the ink from leaking freely from the nozzle 21, and allows stable discharge of the ink.

Therefore, the replenishment of the subtank 40 with ink not only makes it possible to continuously discharge ink from the nozzle 21, but also makes it possible to, with respect to atmospheric pressure, maintain the pressure of the ink in the line head 20 to a negative pressure within a range in which the ink can be stably discharged, while preventing the ink from leaking from the nozzle 21. The replenishment using the ink can be performed when the printing (ink discharge) is not performed or when the printing is performed.

Figure 14A:
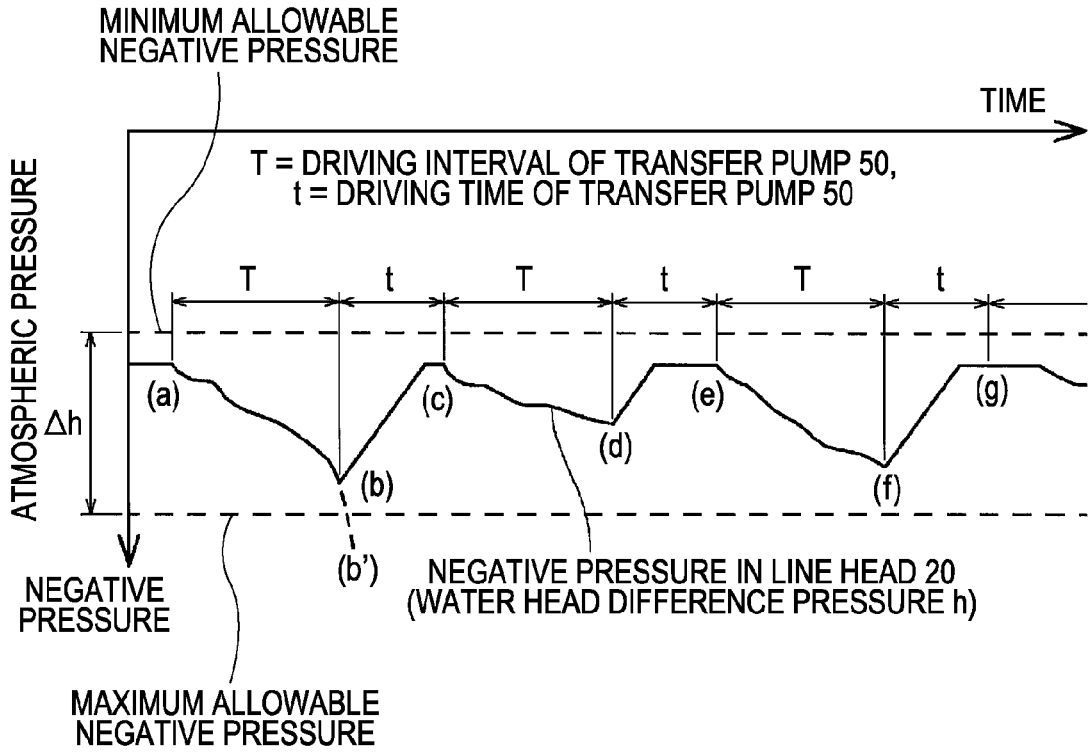
FIGS. 14A and 14B are graphs schematically showing changes in negative pressure (water head differential pressure h) in the line head of the inkjet printer according to the embodiment.
Figure 14B:
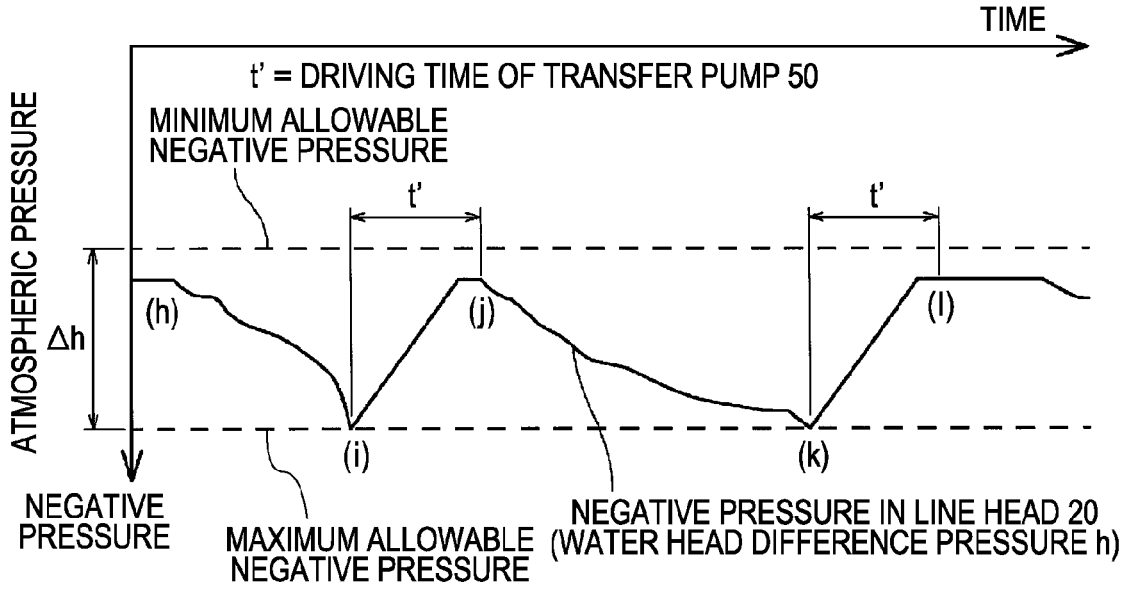

FIGS. 14A and 14B are graphs schematically showing changes in negative pressure (water head differential pressure h) in the line head 20 of the inkjet printer 10 (see FIG. 13) according to the embodiment.

In the graphs shown in FIGS. 14A and 14B, a pressure range Δh refers to a range between a minimum allowable negative pressure and a maximum allowable negative pressure, the range allowing ink to be stably discharged while preventing the ink from leaking from the nozzle 21 (see FIG. 13). Therefore, it is necessary to maintain the pressure of the ink in the line head 20 with respect to atmospheric pressure to a negative pressure within the range Δh. T denotes a driving interval of the transfer pump 50, and t and t' denote driving times of the transfer pump 50.

Here, first, the subtank 40 (see FIG. 13) is set to a full state with ink (where the water head differential pressure h is in a state (a) shown in FIG. 14A). In this state, the negative pressure is set within the range Δh so as to be slightly greater than the minimum allowable negative pressure. Therefore, if the subtank 40 is full with the ink (that is, the water head differential pressure h is equal to the state (a)), it is possible to stably discharge the ink without allowing the ink to freely leak from the nozzle 21 (see FIG. 13).

Thereafter, as shown in FIG. 13, when the inkjet printer 10 starts printing, ink drops are discharged from the nozzle 21 of the line head 20. By this, an amount of ink that is equivalent to the number of discharged ink drops is supplied to the line head 20 from the subtank 40, thereby reducing the height of the liquid surface of the ink in the subtank 40. Therefore, the water head difference between the line head 20 and the subtank 40 is increased, and, as shown in FIG. 14A, the water head differential pressure h changes from the state (a) to a state (b). When the printing is continued, the water head differential pressure h is further increased, and is set to a state (b'), thereby exceeding the maximum allowable negative pressure and, thus, being set outside the range Δh.

To overcome this problem, the transfer pump 50 is periodically driven, to replenish the subtank 40 (see FIG. 13) with ink. More specifically, previously assuming a maximum consumption amount of ink (for example, the ink consumption amount when printing is performed on the basis of a maximum discharge amount), the transfer pump 50 is driven for every driving interval time T that is set so that the water head differential pressure h does not exceed the range Δh even at the maximum consumption amount. Therefore, the height of the liquid surface of the ink in the subtank 40 is increased to reduce to the water head difference, so that the water head differential pressure h is maintained within the range Δh.

The driving of the transfer pump 50 is controlled by a controlling device (not shown) so that the driving time t for driving the transfer pump 50 satisfies t≧(Q/V), where the amount of transfer of ink per unit time of the transfer pump 50 is V, and the amount of change of ink in the subtank 40 (see FIG. 13) that allows the negative pressure of the ink in the line head 20 to be maintained in the range Δh is Q. When the transfer pump 50 is driven while printing (ink discharge) is not performed, t may satisfy t≧(Q/V). However, when the transfer pump 50 is driven while printing is performed, it is necessary to perform replenishment using ink when the ink is consumed by the printing, so that t≧(2Q/V).

In this way, when the subtank 40 is replenished with ink for t≧(Q/V) or t≧(2Q/V) by the transfer pump 50, as shown in FIG. 9, the amount of ink in the subtank 40 becomes greater than or equal to a certain amount (full amount). In addition, the ink is returned to the ink cartridge 30 from the subtank 40 by the return pipe 86. Therefore, the water head differential pressure h changes from the state (b) shown in FIG. 14A to a state (c) shown in FIG. 14A (that is, the subtank 40 is full with ink, and the water head differential pressure h is equivalent to the state (a)). This causes the water head differential pressure h to be maintained within the range Δh without the negative pressure becoming less than the minimum allowable negative pressure.

When the inkjet printer 10 (see FIG. 13) continues printing (discharging ink drops from the line head 20), the height of the liquid surface of the ink in the subtank 40 (see FIG. 13) is reduced again, as a result of which the water head difference between it and the line head 20 is increased. However, since the transfer pump 50 is driven for the driving interval T, if the water head differential pressure h changes from the state (c) to a state (d), the transfer pump 50 is driven only for the driving time t. Therefore, the water head differential pressure h is returned to a state (e) within the range Δh. Similarly, if the water head differential pressure h is changed from the state (e) to a state (f) by discharging ink drops, the water head differential pressure h is returned from a state (f) to a state (g) by replenishment using ink.

Therefore, even if ink drops are discharged from the line head 20, and the ink in the subtank 40 (see FIG. 13) is consumed, as shown in FIG. 14A, by repeatedly driving the transfer pump 50 by the driving time t for the driving interval T, the subtank 40 can be properly replenished with ink. As a result, the pressure of the ink in the line head 20 is maintained at a negative pressure that is in a proper range with respect to atmospheric pressure (that is, the water head differential pressure h is within the range Δh).

Instead of periodically driving the transfer pump 50 at the driving interval T, the transfer pump 50 may be driven when the negative pressure changes to the maximum allowable negative pressure within the range Δh. FIG. 14B is a graph when the driving of the transfer pump 50 is controlled in this way. The change in the water head differential pressure h is separately detected using, for example, a pressure sensor. More specifically, when it is detected that the amount of ink in the subtank 40 (see FIG. 13) is reduced considerably from that in the full state (that is, the state in which the water head differential pressure h is in a state (h)), and that the negative pressure in the line head 20 reaches the maximum allowable negative pressure (that is, the water differential pressure h reaches a state (i)), the transfer pump 50 is driven. By this, the height of the liquid surface of the ink in the subtank 40 is increased, and, thus, the water head difference is reduced, thereby making it possible to maintain the water head differential pressure h within the range Δh.

Here, as shown in FIG. 9, the driving time t' of the transfer pump 50 is set to a time until when the amount of ink in the subtank 40 becomes greater than or equal to the certain amount (that is, the full amount) and the ink is returned to the ink cartridge 30 from the subtank 40 by the return pipe 86. Therefore, the water head differential pressure h changes from the state (i) to a state (j) shown in FIG. 14B (that is, the subtank 40 is full with ink and the water head differential pressure h is equivalent to the state (h)). By this, the water head differential pressure h is maintained within the range Δh without the negative pressure becoming smaller than the minimum allowable negative pressure. Similarly, if the water head differential pressure h changes from the state (j) to a state (k) by the discharge of ink drops, the water head differential pressure h is returned from the state (k) to a state (l) by replenishment with ink.

Therefore, even if ink drops are discharged from the line head 20, and the ink in the subtank 40 (see FIG. 13) is consumed, as shown in FIG. 14B, by driving the transfer pump 50 only by the driving time t' after it is detected that the water head differential pressure h becomes the maximum allowable negative pressure, it is possible to properly replenish the subtank 40 with ink. As a result, the pressure of the ink in the line head 20 is maintained at a negative pressure within the proper range with respect to atmospheric pressure (that is, at the water head differential pressure h within the range Δh). The transfer pump 50 may be driven when printing (ink discharge) is not performed or while continuing printing. In addition, the transfer pump 50 may be constantly driven.

The inkjet printer 10 (see FIG. 2) according to the embodiment performs color printing using inks of four colors. Therefore, for example, four line heads 20 and four subtanks 40 (see FIG. 2) are disposed for the respective ink colors. However, when printing is performed, the ink consumption amounts for the respective colors are not necessarily the same. Therefore, the height of the liquid surface of the ink in each subtank 40 is different. Therefore, the negative pressures in the respective line heads 20 are not the same.

Figure 15A:
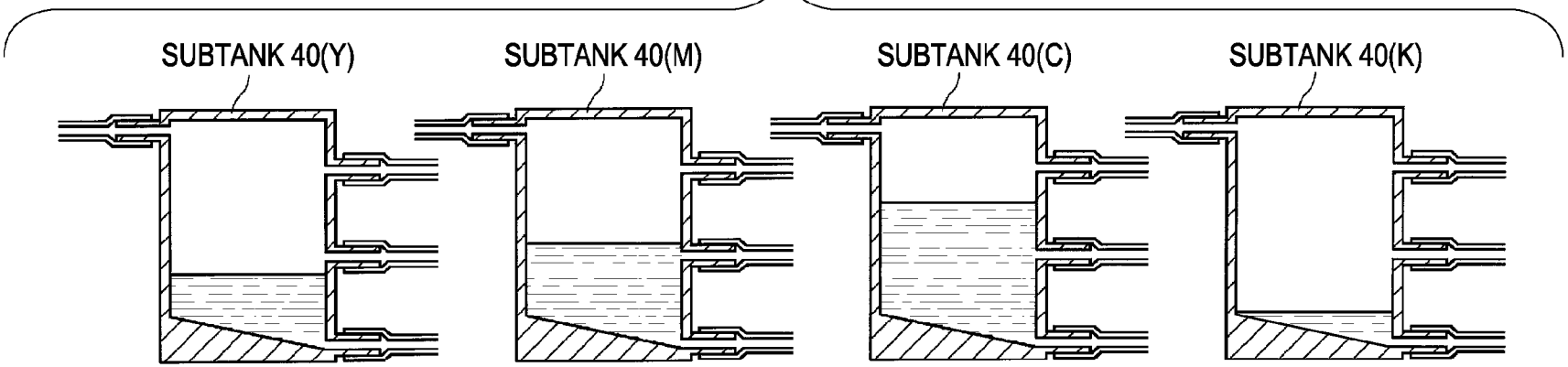
FIGS. 15A and 15B are sectional views of heights of liquid surfaces of ink in four subtanks in the inkjet printer according to the embodiment.
Figure 15B:
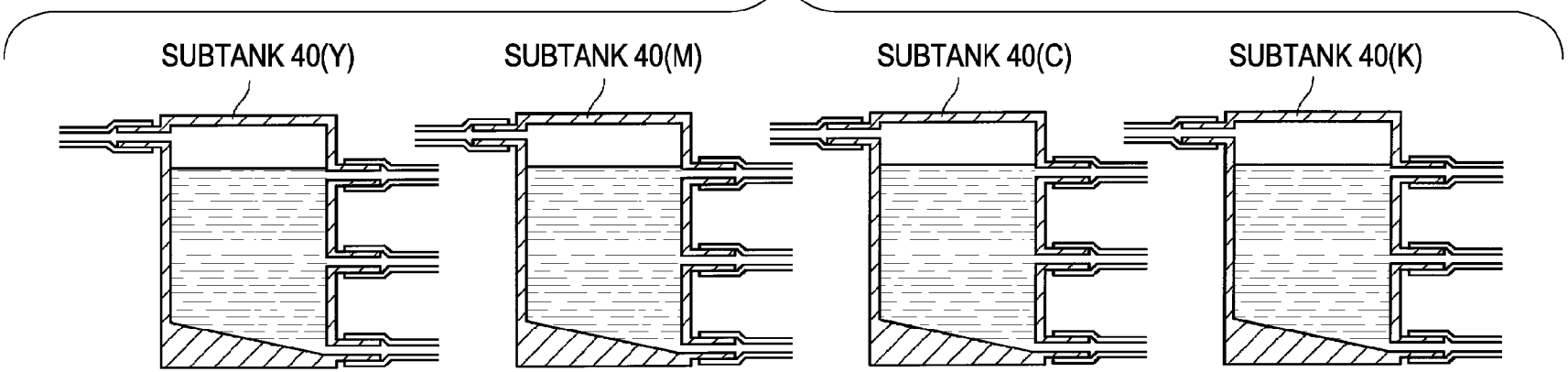

FIGS. 15A and 15B are sectional views of heights of liquid surfaces of ink in the four subtanks of the inkjet printer 10 (see FIG. 2) according to the embodiment.

As shown in FIG. 15A, when printing (ink discharge) is performed by the inkjet printer 10, differences between the ink consumption amounts for four colors (Y, M, C, and K) cause the ink liquid surface heights in the subtank 40(Y), the subtank 40(M), the subtank 40(C), and the subtank 40(K) to differ from each other. When the printing is continued in this state, in the subtank 40(*k*) that consumes the most ink, the water head differential pressure h exceeds the maximum allowable negative pressure, and is set outside the range Δh, as with the state (b') shown in FIG. 14A.

To overcome this problem, as shown in FIG. 13, the subtank 40 is replenished with ink from the ink cartridge 30 by driving the transfer pump 50. More specifically, one driving motor 51 is controlled by a controlling device (not shown), and four transfer pumps 50 are driven at the same time (for example, they are driven only by the driving time t for the driving interval T as shown in FIG. 14A). Therefore, a shown in FIG. 15A, the four subtanks 40 (Y, M, C, and K) having different ink liquid surface heights are replenished with ink at the same time.

In this case, the subtank 40(K) having the smallest amount of ink and the subtank 40(C) having the largest amount of remaining ink are replenished with ink by the same amount of time. However, as shown in FIG. 9, when the amount of ink in the subtank 40 becomes greater than or equal to the certain amount (the full state), the ink is returned to the ink cartridge 30 from the subtank 40 by the return pipe 86. Therefore, even if the subtank 40(K) shown in FIG. 14A is replenished with ink until it is full, ink does not overflow from the subtank 40(C). As a result, as shown in FIG. 15B, the ink liquid surface heights in the four subtanks 40(Y, M, C, and K) become the same.

In this way, if, before the water head differential pressure h exceeds the maximum allowable negative pressure (see FIG. 14), the replenishment using ink is performed in accordance with the subtank 40(K) that takes the most time to be replenished among the four subtanks 40(Y, M, C, and K), all of the subtanks 40(Y, M, C, and K) become full. Therefore, it is not necessary to individually replenish the subtanks 40(Y, M, C, and K) with ink. In addition, for the four line heads 20 (see FIG. 2), using one procedure, the pressure in each line head 20 can maintained to a negative pressure in the proper range with respect to atmospheric pressure (that is, to the water head differential pressure h within the range Δh shown in FIG. 14). Moreover, since the four transfer pumps 50 (see FIG. 2), used to replenish the respective subtanks 40 (Y, M, C, and K) with ink, are driven by one driving motor 51 (see FIG. 2), it is possible to reduce size and costs.

When printing (ink discharge) is performed by the inkjet printer 10 (see FIG. 13), not only is the ink in each of the subtanks 40 (Y, M, C, and K) consumed, but also air bubbles are included in the ink. As a result, even if each of the subtanks 40(Y, M, C, and K) is replenished with ink, and the water head differential pressure h is kept within the range Δh shown in FIG. 14, the stability with which the ink is discharged is reduced. Therefore, by circulating the ink, the air bubbles in the ink in each of the subtanks 40(Y, M, C, and K) are removed.

Figure 16:
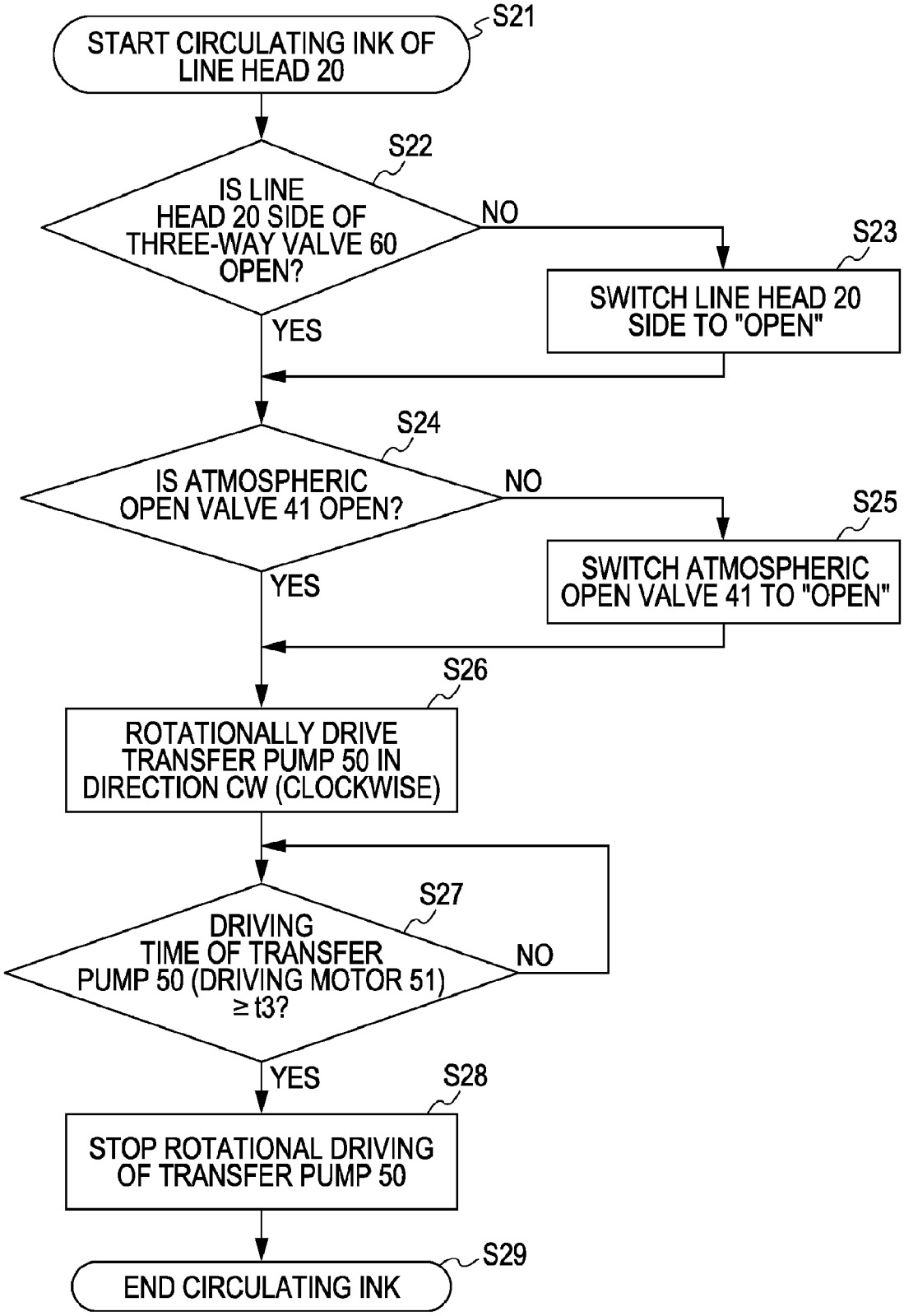
FIG. 16 is a flowchart for removing air bubbles in the ink in the line head of the inkjet printer according to the embodiment.

FIG. 16 is a flowchart for removing air bubbles in the ink in the line head 20 of the inkjet printer 10 (see FIG. 3) according to the embodiment.

Figure 17:
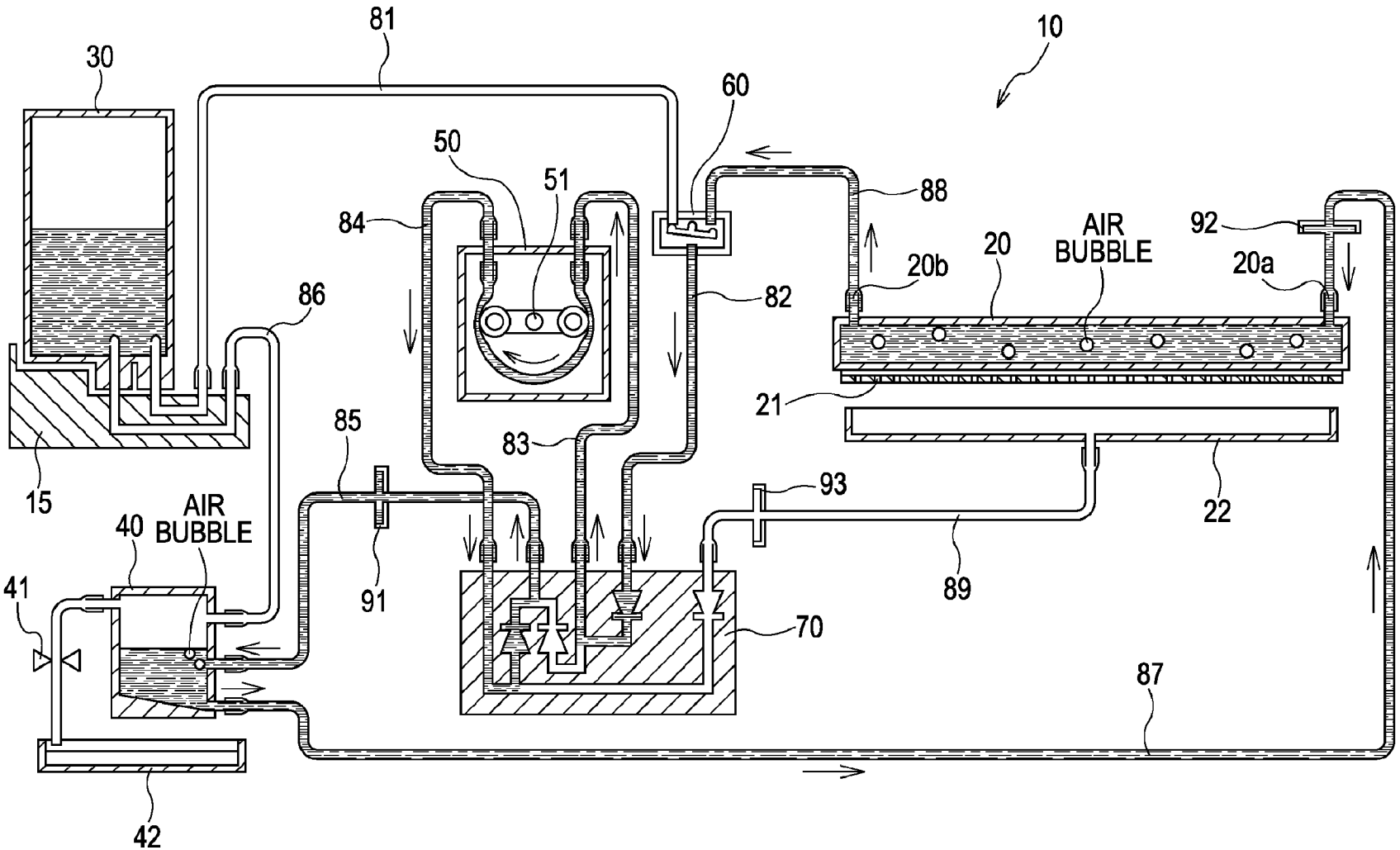
FIG. 17 is a conceptual diagram of the piping system for one color of the printing section of the inkjet printer according to the embodiment, and shows a state in which air bubbles in the ink in the line head are being removed.

FIG. 17 is a conceptual diagram of the piping system for one color of the printing section of the inkjet printer 10 according to the embodiment, and shows a state in which air bubbles in the ink in the line head 20 are being removed.

To remove the air bubbles in the ink in the line head 20, as shown in FIG. 17, the ink is circulated between the line head 20 and the subtank 40. More specifically, when, in Step S21 shown in FIG. 16, circulation of the ink in the subtank 40 is started, then, in Step S22, it is detected whether or not the line head 20 side of the three-way valve 60 is open. If it is not open, the process is branched to Step S23 to switch the state of the line head 20 side to an open state. The three-way valve 60 shown in FIG. 17 is in a state in which the line head 20 side is open.

If the line head 20 side of the three-way valve 60 is open, the process proceeds to Step S24, and it is detected whether or not the atmospheric open valve 41 of the subtank 40 (see FIG. 17) is open. If it is not open, the process is branched to Step S25 to switch the state of the atmospheric open valve 41 to an open state. The atmospheric open valve 41 shown in FIG. 7 is shown as being open.

In this way, after opening the line head 20 side of the three-way valve 60 and opening the atmospheric open valve 41, the transfer pump 50 is rotationally driven in the direction CW (clockwise) in Step S26. The transfer pump 50 shown in FIG. 17 is shown in a state in which it is rotationally driven in the direction CW (clockwise) by the driving motor 51 that is controlled by a controlling device (not shown).

When the transfer pump 50 is rotationally driven in the direction CW (clockwise), ink is transferred in the forward direction (the direction CW) as shown by the arrow in the transfer pump 50 shown in FIG. 17. By this, air bubbles in the ink in the line head 20 are transferred with the ink, and, as shown by the arrows shown in FIG. 17, are transferred to the subtank 40 through the discharge pipe 88, the three-way valve 60, the transfer pipe 82, the check valve array 70, the transfer pipe 83, the transfer pump 50, the transfer pipe 84, the check valve array 70, the transfer pipe 85, and the filter 91. The air bubbles in the ink transferred to the subtank 40 move out of the ink by buoyancy, and are separated from the ink by gas liquid separation. As a result, the air bubbles are removed from the ink, so that only ink that does not contain air bubbles is stored in the subtank 40.

By the transfer of the ink, the negative pressure in the line head 20 is increased. As a result, an amount of ink resulting from subtracting the reduced amount of ink of the line head 20 is supplied to the line head 20 from the subtank 40 through the supply pipe 87 and the filter 92. Air bubbles are not contained in the supplied ink. Therefore, by transferring the ink in the line head 20 to the subtank 40, and supplying the ink in the subtank 40 to the line head 20 (that is, circulating the ink between the line head 20 and the subtank 40), air bubbles in the line head 20 or in the ink transfer paths are removed at the subtank 40. The interior of the line head 20 is kept at a negative pressure corresponding to the water head difference between the ink liquid surface height in the subtank 40 and that in the line head 20.

Here, a driving time t3 of the transfer pump 50 (driving motor 51) is a sufficient time up to when the ink starts circulating (that is, up to when the ink that was in the line head 20 in the beginning returns to the line head 20 through the subtank 40). Then, in Step S27 shown in FIG. 16, it is detected whether or not the driving time ≧t3. If the driving time ≧t3, the process proceeds to the next Step S28 to stop the rotational driving of the transfer pump 50. By this, air bubbles in the ink in the line head 20 can be removed, and the circulation of the ink ends in Step S29.

Figure 18:
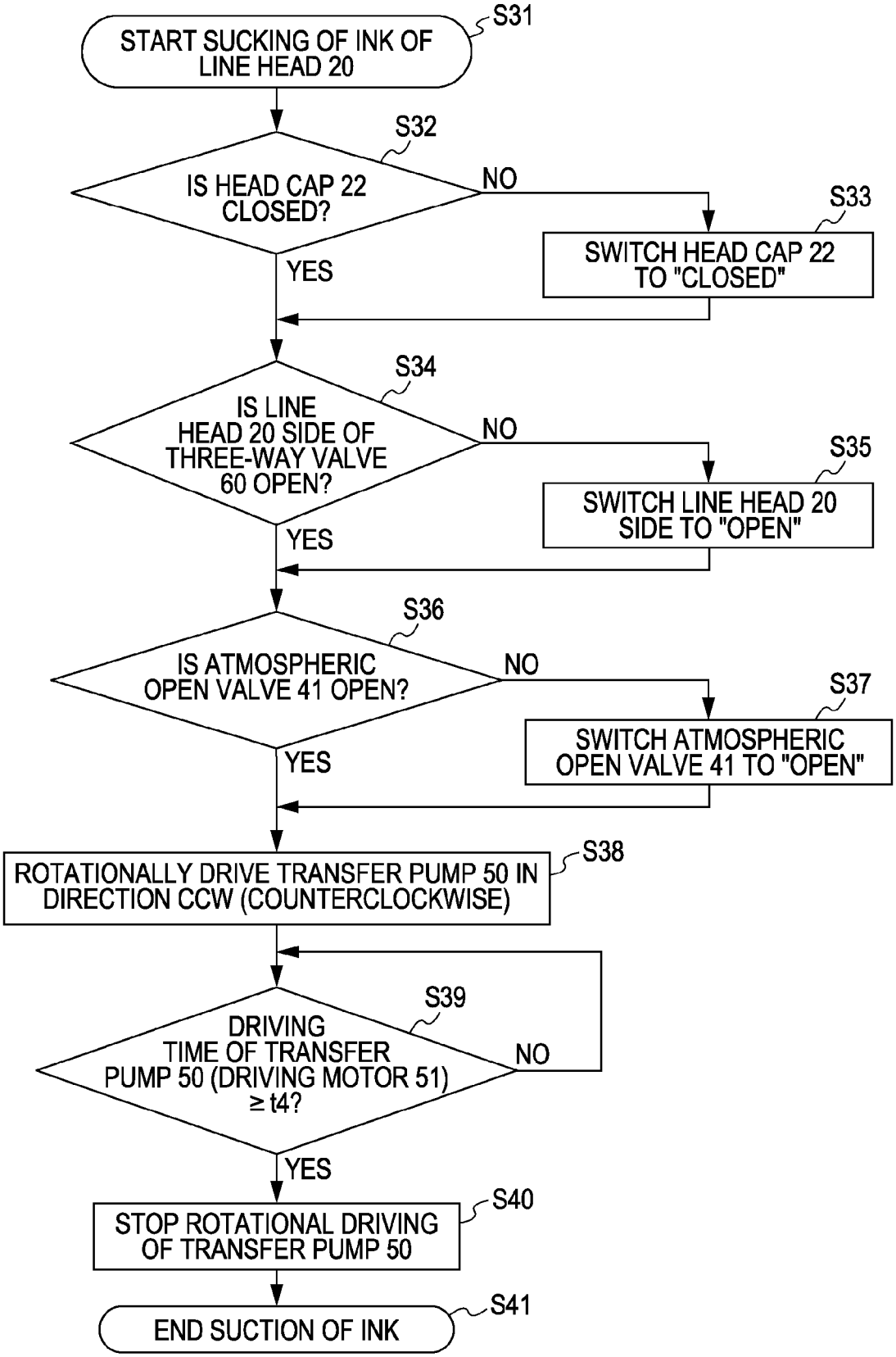
FIG. 18 is a flowchart for removing air bubbles in ink near a nozzle of the inkjet printer according to the embodiment.

FIG. 18 is a flowchart for removing air bubbles in the ink near the nozzle 21 (see FIG. 3) of the inkjet printer 10 (see FIG. 3) according to the embodiment.

Figure 19:
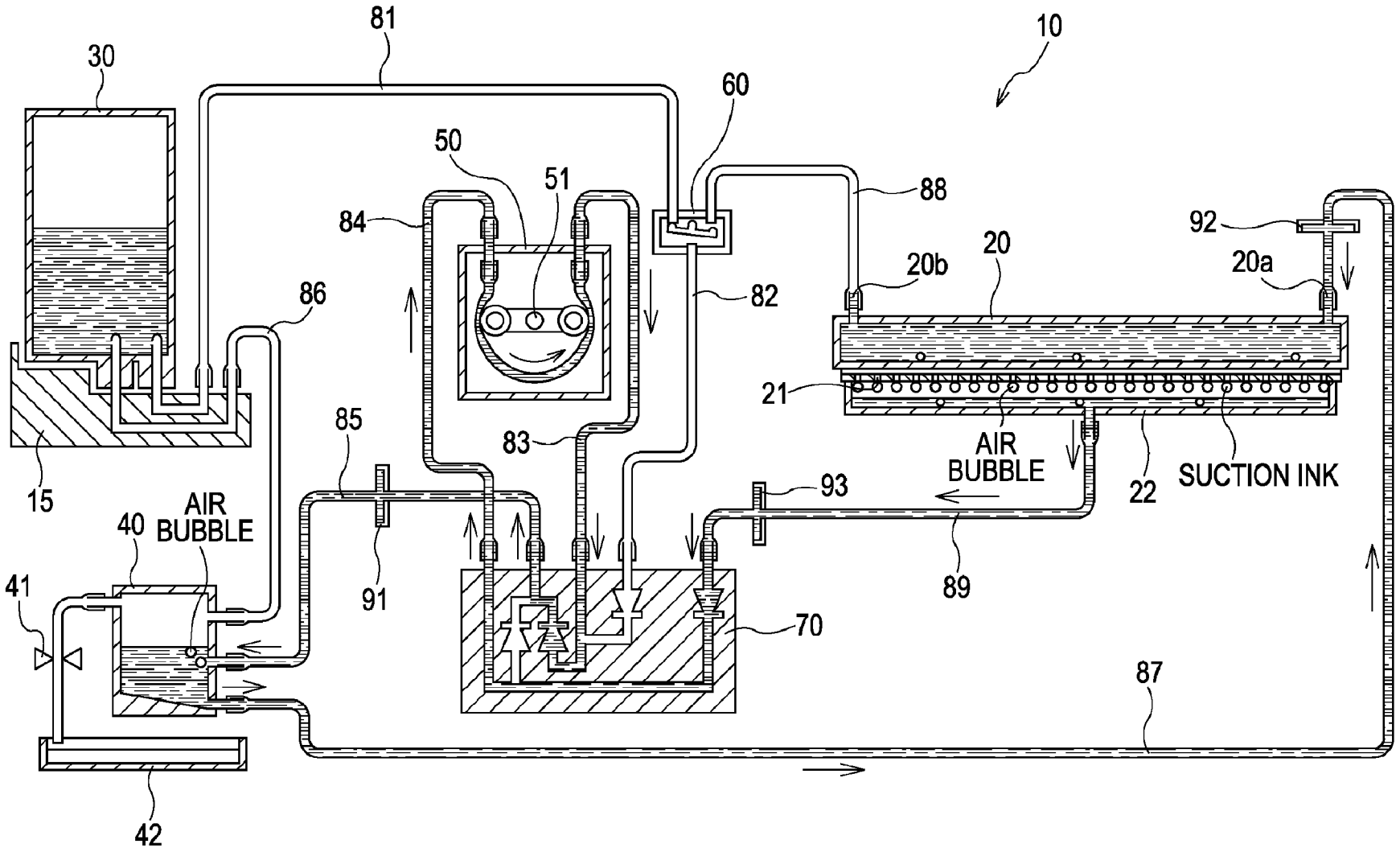
FIG. 19 is a conceptual diagram of the piping system for one color of the printing section of the inkjet printer according to the embodiment, and shows a state in which air bubbles in the ink near the nozzle are being removed.

FIG. 19 is a conceptual diagram of the piping system for one color of the printing section of the inkjet printer 10 according to the embodiment, and shows a state in which air bubbles in the ink near the nozzle 21 are being removed.

To remove the air bubbles in the ink near the nozzle 21, as shown in FIG. 19, the ink is sucked towards the head cap 22 from the nozzle 21, and is circulated between the head cap 22 and the subtank 40. More specifically, when, in Step S31 shown in FIG. 18, the suction of the ink in the line head 20 is started, then, in the next Step S32, it is detected whether or not the head cap 22 is closed. If it is not closed, the process is branched to Step S33 to switch the state of the head cap 22 to a closed state by an opening/closing device (not shown) of the head cap 22, so that the nozzle 21 side of the line head 20 is hermetically sealed by the head cap 22. The head cap 22 shown in FIG. 19 is shown as being in the closed state.

If the head cap 22 is in the closed state, the process proceeds to Step S34 to detect whether or not the line head 20 side of the three-way valve 60 is in the open state. If it is not open, the process is branched to Step S35 to switch the line head 20 side to the open state. The line head 20 side of the three-way valve 60 shown in FIG. 19 is shown as being in the open state.

If the line head 20 side of the three-way valve 60 is open, the process proceeds to Step S36 to detect whether or not the atmospheric open valve 41 of the subtank 40 (see FIG. 19) is open. If it is not open, the process is branched to Step S37 to switch the state of the atmospheric open valve 41 to the open state. The atmospheric open valve 41 shown in FIG. 19 is shown as being in the open state.

In this way, after closing the head cap 22, opening the line head 20 side of the three-way valve 60, and opening the atmospheric open valve 41, the transfer pump 50 is rotationally driven in the direction CCW (counterclockwise) in Step S38. The transfer pump 50 shown in FIG. 19 is in a state in which it is rotationally driven in the direction CCW (counterclockwise) by the driving motor 51 that is controlled by a controlling device (not shown).

When the transfer pump 50 is rotationally driven in the direction CCW (counterclockwise), the ink is transferred in the reverse direction (the direction CCW) as shown by the arrow in the transfer pump 50 shown in FIG. 19. Therefore, a transfer path in which the ink enters from the discharge pipe 89 (connected to the head cap 22), flows out from the transfer pipe 84, and flows towards the transfer pump 50 is formed by the check valve array 70. In addition, a transfer path in which the ink enters from the transfer pipe 83, flows out from the transfer pipe 85, and flows towards the subtank 40 is also formed. When, for example, any foreign matter is mixed in the transferred ink, the foreign matter is removed by the filter 93 before entering the check valve array 70.

Therefore, when the ink is transferred in the reverse direction (the direction CCW), the pressure in the head cap 22 is reduced, so that the ink in the line head 20 is sucked from the nozzle 21. By this, air bubbles near the nozzle 21 are stored along with the ink in the head cap 22. As shown by the arrows shown in FIG. 19, the ink containing the air bubbles in the head cap 22 is transferred to the subtank 40 through the discharge pipe 89, the filter 93, the check valve array 70, the transfer pipe 84, the transfer pump 50, the transfer pipe 83, the check valve array 70, the transfer pipe 85, and the filter 91. By this, the air bubbles in the ink move out of the ink by buoyancy, and are separated from the ink by gas liquid separation, so that the air bubbles are removed from the ink. As a result, only ink that does not contain air bubbles is stored in the subtank 40.

By the suction of the ink from the nozzle 21, the negative pressure in the line head 20 is increased. As a result, an amount of ink resulting from subtracting the reduced amount of ink of the line head 20 is supplied to the line head 20 from the subtank 40 through the supply pipe 87 and the filter 92. Air bubbles are not mixed in the supplied ink. The interior of the line head 20 is kept at a negative pressure corresponding to the water head difference between the ink liquid surface height in the subtank 40 and that in the line head 20.

Here, a driving time t4 of the transfer pump 50 (driving motor 51) is a sufficient time up to when the ink circulates (that is, up to when the ink that was in the line head 20 in the beginning is sucked towards the head cap 22 from the nozzle 21 and returns to the line head 20 through the subtank 40). Then, in Step S39 shown in FIG. 18, it is detected whether or not the driving time ≧t4. If the driving time ≧t4, the process proceeds to the next Step S40 to stop the rotational driving of the transfer pump 50. By this, air bubbles in the ink near the nozzle 21 can be removed, and the suction of the ink ends in Step S41.

By Steps S34 and S35, the line head 20 side of the three-way valve 60 is open. Therefore, if, as in Step S38, the transfer pump 50 is rotationally driven in the direction CCW (counterclockwise), relatively small air bubbles in the ink near the nozzle 21 can be removed. If, as in Step S26 shown in FIG. 16, the transfer pump 50 is rotationally driven in the direction CW (clockwise), relatively large air bubbles in the ink in the line head 20 can be removed. Therefore, by only reversing the driving direction of the transfer pump 50, all of the air bubbles in the ink can be removed. Not only the ink in the line head 20, but also the ink sucked to the head cap 22 can also be circulated, and returned to the line head 20. Therefore, it is possible to reduce wasteful consumption of ink.

The present application contains subject matter related to that disclosed in Japanese Priority Patent Applications JP 2008-196303, JP 2008-196304, JP 2008-196305, and JP 2008-196306, filed in the Japan Patent Office on Jul. 30, 2008, the entire content of which is hereby incorporated by reference.

Although an embodiment of the present invention is described, the present invention is not limited to the above-described embodiment, so that various modifications, such as those mentioned below, are possible.

(1) In the embodiment, the inkjet printer 10 including the line head 20 for a printing width is given as an example of the liquid supplying device and the liquid discharging device. However, in addition to being the inkjet printer 10, they may also be a serial-head inkjet printer.

In addition, the present invention is widely applicable to various other liquid discharging devices that discharge various other liquids (such as liquid discharging devices that discharge dye to a dye object).

(2) In the embodiment, the tube pump that transfers ink by continuously resiliently deforming a resilient tube (such as a piston pump) is given as an example of the transfer pump 50. However, in addition to the tube pump, other types of pumps (such as a piston pump) may also be used.

What is claimed is:

1. A liquid supplying device comprising:

a liquid tank storing liquid that is supplied to a consumption object that consumes the liquid;

a transfer pump for transferring the liquid stored in the liquid tank;

an auxiliary tank temporarily storing the liquid transferred by the transfer pump before supplying the liquid to the consumption object;

a return pipe disposed so as to return the liquid to the liquid tank from the auxiliary tank when an amount of the liquid stored in the auxiliary tank becomes greater than or equal to a certain amount; and an atmospheric open valve operable to maintain internal pressures of the liquid tank and the auxiliary tank at atmospheric pressure when the internal pressure of the liquid tank is reduced due to transfer of the liquid from the liquid tank.

2. The liquid supplying device according to claim 1, further comprising:

a transfer pipe connected to the transfer pump, the transfer pipe transferring the liquid; and a tank mounting section to which the transfer pipe and the return pipe are connected, the tank mounting section capable of having the liquid tank removably mounted thereto.

3. The liquid supplying device according to claim 1, wherein the atmospheric open valve is connected to the liquid tank via the auxiliary tank and the return pipe.

4. The liquid supplying device according to claim 1, wherein the return pipe is operable to deliver air or the liquid to the liquid tank.

5. The liquid supplying device according to claim 4, wherein, the return pipe is operable to transmit air from the auxiliary tank and the atmospheric open valve when the liquid in the tank is below an entrance to the return pipe in the auxiliary tank so that the internal pressures of the liquid tank and the auxiliary tank are equalized, and the return pipe is operable to transmit the liquid from the auxiliary tank when the liquid in the tank reaches the entrance to the return pipe in the auxiliary tank.

6. A liquid discharging device comprising:

a liquid discharging head capable of discharging supplied liquid from a nozzle;

a liquid tank storing the liquid that is discharged by the liquid discharging head;

a transfer pump for transferring the liquid stored in the liquid tank;

an auxiliary tank temporarily storing the liquid transferred by the transfer pump before supplying the liquid to the liquid discharging head;

a return pipe disposed so as to return the liquid to the liquid tank from the auxiliary tank when an amount of the liquid stored in the auxiliary tank becomes greater than or equal to a certain amount; and an atmospheric open valve operable to maintain internal pressures of the liquid tank and the auxiliary tank at atmospheric pressure when the internal pressure of the liquid tank is reduced due to transfer of the liquid from the liquid tank.

7. The liquid discharging device according to claim 6, comprising a plurality of the liquid discharging heads, a plurality of the liquid tanks, a plurality of the transfer pumps, a plurality of the auxiliary tanks, and a plurality of the return pipes, in accordance with types of the liquid discharged from the nozzle.

8. The liquid discharging device according to claim 7, further comprising one driving source capable of simultaneously driving the plurality of the transfer pumps.

9. The liquid discharging device according to claim 6, wherein the atmospheric open valve is operable to free gas in the auxiliary tank to the atmosphere and receive gas from the atmosphere to the auxiliary tank.

10. The liquid discharging device according to claim 6, wherein the auxiliary tank is disposed below the nozzle so that, with respect to atmospheric pressure, pressure of the liquid in the liquid discharging head is capable of being maintained at a negative pressure in a range allowing the liquid to be stably discharged while preventing leakage of the liquid from the nozzle.

11. The liquid discharging device according to claim 6, wherein the atmospheric open valve is connected to the liquid tank via the auxiliary tank and the return pipe.

12. The liquid discharging device according to claim 6, wherein the return pipe is operable to deliver air or the liquid to the liquid tank.

13. The liquid discharging device according to claim 12, wherein, the return pipe is operable to transmit air from the auxiliary tank and the atmospheric open valve when the liquid in the tank is below an entrance to the return pipe in the auxiliary tank so that the internal pressures of the liquid tank and the auxiliary tank are equalized, and the return pipe is operable to transmit the liquid from the auxiliary tank when the liquid in the tank reaches the entrance to the return pipe in the auxiliary tank.

14. A method of controlling a liquid discharging device comprising a liquid discharging head capable of discharging supplied liquid from a nozzle, a liquid tank storing the liquid that is discharged by the liquid discharging head, a transfer pump for transferring the liquid stored in the liquid tank, a controlling device for controlling driving of the transfer pump, an auxiliary tank temporarily storing the liquid transferred by the transfer pump before supplying the liquid to the liquid discharging head, the auxiliary tank being disposed below the nozzle so that pressure of the liquid in the liquid discharging head is a negative pressure, a return pipe disposed so as to return the liquid to the liquid tank from the auxiliary tank when an amount of the liquid stored in the auxiliary tank becomes greater than or equal to a certain amount, and an atmospheric open valve operable to maintain internal pressures of the liquid tank and the auxiliary tank at atmospheric pressure when the internal pressure of the liquid tank is reduced due to transfer of the liquid from the liquid tank, the method comprising:

driving the transfer pump so that $t \geqq (Q/V)$ by the controlling device, where a driving time for driving the transfer pump is t, an amount of the transfer of the liquid per unit time by the transfer pump is V, and an amount of change of the liquid in the auxiliary tank is Q, the amount of change of the liquid in the auxiliary tank allowing, with respect to atmospheric pressure, the pressure of the liquid in the liquid discharging head to be maintained at the negative pressure in a range allowing the liquid to be stably discharged while preventing leakage of the liquid from the nozzle.

15. The method according to claim 14, further comprising:

transmitting air from the auxiliary tank and the atmospheric open valve via the return pipe when the liquid in the tank is below an entrance to the return pipe in the auxiliary tank so that the internal pressures of the liquid tank and the auxiliary tank are equalized, and transmitting the liquid from the auxiliary tank via the return pipe when the liquid in the tank reaches the entrance to the return pipe in the auxiliary tank.

* * * * *